US006304735B1

(12) United States Patent
Nishimura et al.

(10) Patent No.: US 6,304,735 B1
(45) Date of Patent: Oct. 16, 2001

(54) IMAGE FORMING APPARATUS HAVING AN ELECTRICALLY CHARGED PAPER DUST REMOVING BRUSH

(75) Inventors: Soichiro Nishimura; Takeshi Fuwazaki, both of Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/602,192

(22) Filed: Jun. 22, 2000

(30) Foreign Application Priority Data

| | | |
|---|---|---|
| Jun. 22, 1999 | (JP) | 11-175318 |
| Jun. 24, 1999 | (JP) | 11-177867 |
| Sep. 24, 1999 | (JP) | 11-270039 |
| Mar. 24, 2000 | (JP) | 12-088566 |

(51) Int. Cl.[7] ..... G03G 21/00

(52) U.S. Cl. ..... 399/98; 399/354

(58) Field of Search ..... 399/98, 150, 353, 399/354

(56) References Cited

U.S. PATENT DOCUMENTS 5,819,138 * 10/1998 Hashizume ..... 399/98

* cited by examiner

*Primary Examiner*—Joan Pendegrass
(74) *Attorney, Agent, or Firm*—Oliff & Berridge, PLC

(57) ABSTRACT

In an image forming apparatus, a brush member is formed from a brush made from acrylic resin that has not been subjected to conductivity-enhancing processes. The brush member is attached to a conductive plate. A resistor is provided in series with the conductive plate and a fixed power source. The fixed power source applies a predetermined high voltage to the conductive plate.

37 Claims, 15 Drawing Sheets

IMAGE FORMING APPARATUS HAVING AN ELECTRICALLY CHARGED PAPER DUST REMOVING BRUSH

BACKGROUND OF THE INVENTION

1. Field of the Invention

The present. invention relates to an image forming apparatus such as a laser printer.

2. Description of Related Art

Laser printers and other image forming apparatuses mainly include: a photosensitive drum, a developing roller, and a transfer roller. The photosensitive drum is formed with an electrostatic latent image on its outer peripheral surface. The developing roller is disposed in confrontation with the photosensitive drum. The developing roller supplies developing agent, such as toner, to the photosensitive drum, thereby developing the electrostatic latent image into a visible image. The transfer roller is disposed also in confrontation with the photosensitive drum. The transfer roller is applied with a transfer bias voltage with a polarity opposite to that of the photosensitive drum.

Especially In non-contact type printers, a charger uniformly charges the outer peripheral surface of the photosensitive drum. A laser generating unit modulates a laser beam based on image data, and scans the laser beam across the outer peripheral surface of the photosensitive drum. As a result, a corresponding electrostatic latent image is formed on the surface of the photosensitive drum. The developing roller conveys, on its surf ace, toner that is electrically charged to the same polarity as that of the photosensitive drum. The electrostatic latent image on the photosensitive drum is developed into a visible toner image with the toner supplied from the developer roller according to a well-known reversal development process. The thus developed visible image is then transferred from the photosensitive drum onto a sheet of paper that is passing between the photosensitive drum and the transfer roller. The visible image is pulled onto the sheet of paper by an electrostatic field that is generated by the transfer blabs applied to the transfer roller. Thus, one image forming cycle is completed.

According to the above-described image forming cycle, some toner remains on the surface of the photosensitive drum after the toner image has been transferred from the photosensitive drum onto the sheet of paper. According to a well-known cleanerless method, this residual toner is collected during the next image forming cycle. Thus, in each image forming cycle, development and cleaning are performed simultaneously by the developing roller according to reversal development process.

According to this cleanerless method, there is no need to provide a blade or other type of cleaner device in the image forming apparatus. There is also no need to provide a vessel to accumulate waste toner. Accordingly, configuration of the entire image forming apparatus can be simplified and made compact. The image forming apparatus can be produced less expensively.

It is noted that when the sheet of paper passes between the photosensitive drum and the transfer roller, paper dust clings to the surface of the photosensitive drum. This paper dust will be possibly collected together with the residual toner. When the toner is reused during a later development process, the paper dust can degrade the resultant visible image. When an acid type sheet is used as the sheet of paper, the paper dust includes filler material such as talc. The filler material can cause filming and so magnify the problem of the defective visible images.

In view of the above-described problems, there has been proposed that the cleanerless-type image forming apparatus be provided with a paper-dust removing device such as a brush. The paper-dust removing device is positioned In contact with the photosensitive drum in order to remove the paper dust that clings to the photosensitive drum.

However, because the paper-dust removing device is in contact with the photosensitive drum, the residual toner also clings to the paper-dust removing device together with the paper dust. This will reduce the ability of the paper-dust removing device to remove the paper dust. The toner clinging to the paper-dust removing device can be smashed into the surface of the photosensitive drum, thereby generating filming of toner on the surface of the photosensitive drum.

SUMMARY OF THE INVENTION

A configuration is conceivable to overcome the above-described problems. In this conceivable configuration, the brush is subjected to a conductivity-enhancing processes, such as processes for dispersing conductive particles throughout the brush. The brush is applied with an electric voltage to catch only paper dust using power of the electrical field.

Paper dust normally has a negative charge. Additionally, the transfer bias potential, applied at the transfer roller, charges the sheet of paper to an electric polarity opposite to that of toner. Therefore, if positively-charging toner is used, paper dust will be strongly charged to a negative polarity at the stage between the transfer stage and the charge stage. By applying the conductivity-enhanced brush with a voltage having the same polarity as the toner, the brush will pick up only paper dust without picking up the toner much better compared to when no voltage is applied.

When a high electric voltage is applied to the conductivity-enhanced brush, however, the resistance value of the brush will decrease exponentially with respect to the applied voltage. When an excessively high voltage is applied, the brush might break down so that the resistance value suddenly lowers.

The surface potential of the photosensitive drum fluctuates, after the transfer stage, depending on the type of paper used and the ambient environment. It is difficult to adjust the voltage applied to the brush by using a fixed voltage control to control ON and OFF of a voltage of a fixed amount. Several problems occur. For example, when the surface potential of the photosensitive drum drops, for some reasons, below a certain normal value, the difference between the surface potential of the photosensitive drum and the voltage applied to the brush can become so large. In this case, electric currents may directly flow from the brush to the photosensitive body, thereby causing non-uniform charges on the photosensitive body. When this non-uniformity is too large, the non-uniformity cannot be corrected even by the charge operations by the charger. This problem is especially striking when a charge removing lamp, such as an erase lamp, is dispensed with to reduce the number of components in the entire image forming apparatus.

It is therefore an objective of the present invention to provide an improved image forming apparatus which is capable of properly removing paper dust only, without generating non-uniform charges on the photosensitive body, even when the difference between the surface potential of the photosensitive body and the voltage applied to the brush increases.

In order to attain the above and other objects, the present invention provides an image forming apparatus, comprising;

an image bearing body having a surface that bears thereon a visible image, which is formed through development of an electrostatic latent image by developing agent, and that conveys the visible image to a predetermined transfer position; a transfer member, located on the transfer position, transferring the visible image from the image bearing body onto a sheet of paper: a paper dust removing member that removes paper dust clinging to the surface of the image bearing body after the visible image is transferred from the image bearing body onto the sheet of paper, the paper dust removing member including a brush member that contacts the image bearing body and that is made of fiber material whose resistance has a value preventing discharges from occurring from the brush member toward the surface of the image bearing body; and a bias voltage applying member that applies an electric bias voltage to the paper dust removing member.

The brush member may be made of fiber material which has not been subjected to a conductivity-enhancing process. The brush member may be made of fiber material whose resistance value is in a range of $10^8$ to $10^{10}$ Ω.

The bias voltage applying member may supply the paper dust removing member with an electric voltage that has an amount allowing a potential difference of one kilovolts or more to occur between the paper dust removing member and the surface of the image bearing body that confronts the paper dust removing member. The bias voltage applying member may include a voltage source that applies a fixed amount of voltage to the paper dust removing member.

The image forming apparatus may further comprises an electric charging unit that has a corona discharge electrode generating a corona discharge to electrically charge the surface of the image bearing body; and an electrostatic latent image forming unit that forms the electrostatic latent image on the electricallyrcharged surface of the image bearing body; and a developing unit that develops the electrostatic latent image into the visible image by using the developing agent, wherein the bias voltage applying member includes an electric charge catching electrode for catching electric charge discharged from the corona discharge electrode and for applying the electric charge to the paper dust removing member.

The electric charge catching electrode may be provided to confront the corona discharge electrode. The electric charge catching electrode may be electrically connected to the paper dust removing member.

According to another aspect, the present invention provides a process cartridge detachable mounted in an image forming device, the process cartridge comprising: an image bearing body having a surface that bears thereon a visible image, which is formed through development of an electrostatic latent image by developing agent, and that conveys the visible image to a predetermined transfer position; a transfer member, located on the transfer position, transferring the visible image from the image bearing body onto a sheet of paper: a paper dust removing member that removes paper dust clinging to the surface of the image bearing body after the visible image is transferred from the image bearing body onto the sheet of paper, the paper dust removing member including a brush member that contacts the image bearing body and that is made of fiber material whose resistance has a value preventing discharges from occurring from the brush member toward the surface of the image bearing body; and a bias voltage applying member that applies an electric bias voltage to the paper dust removing member.

The process cartridge may further comprise: an electric charging unit that has a corona discharge electrode generating a corona discharge to electrically charge the surface of the image bearing body; and an electrostatic latent image forming unit that forms the electrostatic latent image on the electrically-charged surface of the image bearing body; and a developing unit that develops the electrostatic latent image into the visible image by using the developing agent, wherein the bias voltage applying member includes an electric charge catching electrode for catching electric charge discharged from the corona discharge electrode and for applying the electric charge to the paper dust removing member.

BRIEF DESCRIPTION OF THE DRAWINGS

The above and other objects, features and advantages of the invention will become more apparent from reading the following description of the preferred embodiments taken in connection with the accompanying drawings in which.

DETAILED DESCRIPTION OF TEE PREFERRED EMBODIMENTS

Figure 1:
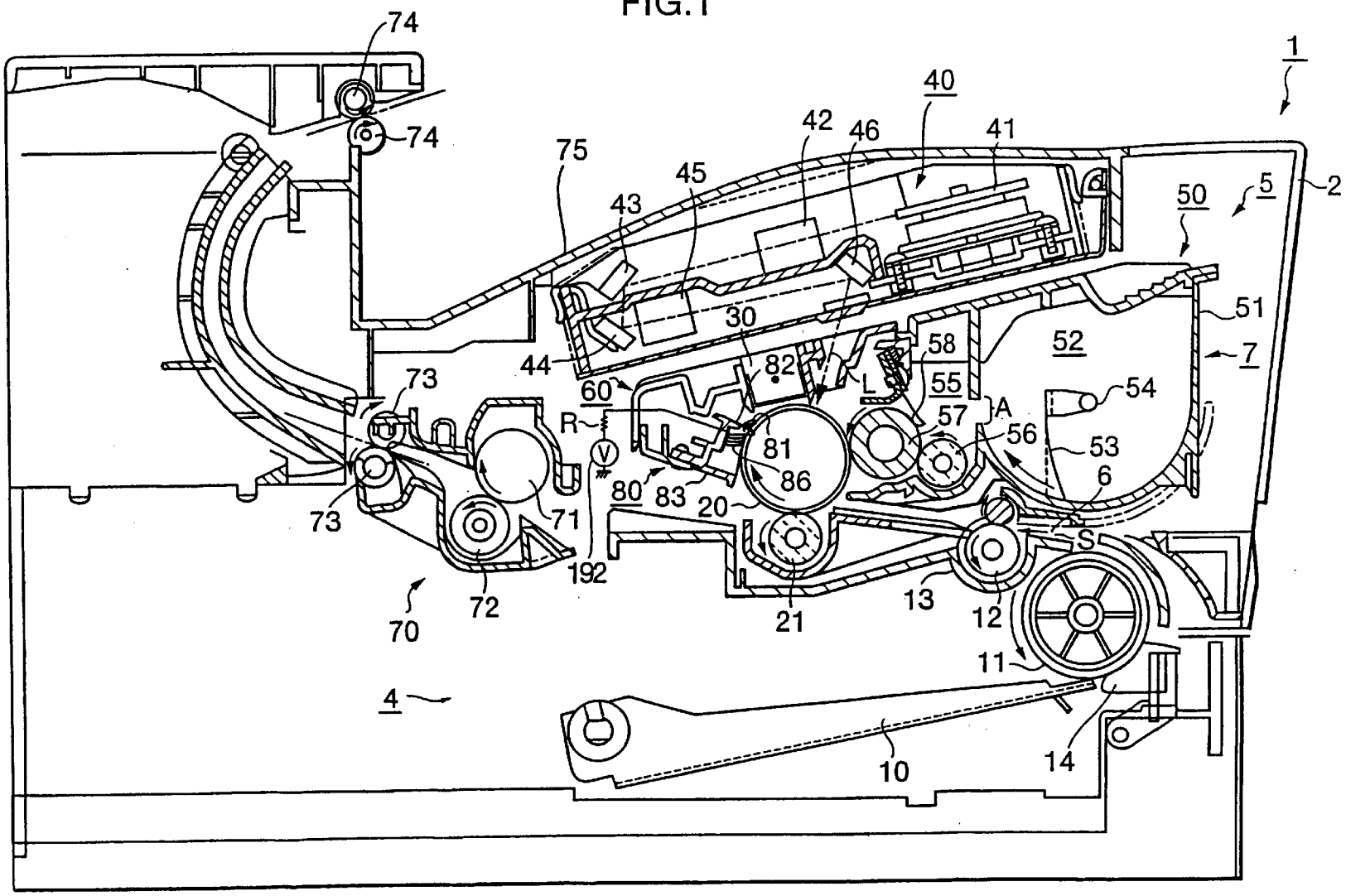
FIG. 1 is a cross-sectional view showing internal components of an image forming apparatus according to a first embodiment of the present invention.

An image forming apparatus according to preferred embodiments of the present invention will be described while referring to the accompanying drawings wherein like parts and components are designated by the same reference numerals to avoid duplicating description.

First Embodiment

An image forming apparatus according to a first embodiment of the present invention will be described below with reference to FIGS. 1 and 2.

FIG. 1 is a cross-sectional view showing essential parts of a laser printer 1 that serves as the image forming apparatus according to the first embodiment. As shown in FIG. 1, the laser printer 1 includes a housing or casing 2, in which a sheet feeding unit 4 and an image printing section 5 are provided. The sheet feed unit 4 is for supplying sheets of paper P (recording medium) to the image printing section 5. The sheets of paper P serve as recording media to be printed with visible toner images. The image printing section 5 is for printing visible toner images onto the sheets of paper P.

As shown in FIG. 1, the sheet feeding unit 4 is disposed at a bottom portion of the housing 2. The sheet feeding unit 4 includes; a sheet pressing plate 10, a sheet friction-separating member 14, a sheet supply roller 11. and a pair of register rollers 12, 13. The sheet supply roller 11 and the sheet friction-separating member 14 are located within the casing 2 above one end of the sheet pressing plate 10. The sheet friction-separating member 14 is pressed against the sheet supply roller 11. The pair of register rollers 12, 13 are provided downstream from the sheet supply roller 11 with respect to a predetermined sheet transport direction S.

Sheets of paper P can be stacked on the sheet pressing plate 10. The sheet pressing plate 10 is pivotably supported at its one end furthest from the sheet supply roller 11. Accordingly, the other end of the sheet pressing plate 10 nearest the sheet supply roller 11 is made movable in the vertical direction. A spring (not shown) is provided for urging the sheet pressing plate 10 upward from its under surface. With this arrangement, when the number of sheets stacked on the sheet pressing plate 10 increases, the sheet pressing plate 10 will pivot downwardly, against the urging force of the spring, around its one end furthest from the sheet supply roller 11. One sheet at the upper most position of the stack on the sheet pressing plate 10 is pressed toward the sheet supply roller 11 by the spring from the under side of the sheet pressing plate 10.

The sheet supply roller 11 and the sheet friction-separating member 14 are disposed in confrontation with each other. When the sheet supply roller 11 rotates, the uppermost sheet is fed from the stack to a position between the sheet supply roller 11 and the sheet friction-separating member 14. As the sheet supply roller 11 further rotates, the uppermost sheet P is fed further toward the pair of register rollers 12, 13. The sheet P fed out by the sheet feed roller 11 has its front edge aliened by the register rollers 12, 13 and then is transported to the image printing section 5. In this way, one sheet at a time is fed out from the sheet feeding unit 4 and is transported along a predetermined sheet transport path 6 in the sheet transport direction S indicated by an arrow in the figure. Thus, a sheet of paper P is transported at a predetermined timing along the sheet transport path 6.

As shown in FIG. 1, the image printing section 5 includes a scanner unit 40, a process cartridge 7, and a fixing unit 70.

The scanner unit 40 is provided in the upper portion within the casing 2. The scanner unit 40 includes X a laser generator portion (not shown in the drawing); a polygon mirror 41; lenses 42 and 45; and reflection mirrors 43, 44, and 46. The laser generating portion is for modulating a laser beam based on image data and for emitting the modulated laser beam. As indicated by a single dot chain line in FIG. 1, laser light emitted from the laser generation portion reflects at the polygon mirror (five-sided mirror, for example) 41, passes through the lens 42, reflects at the reflection mirrors 43 and 44, passes through the lens 45, and reflects at the reflection mirror 46 in this order. The laser beam is finally irradiated across the surface of a photosensitive drum 20 that is provided in the process cartridge 7 as will be described later.

As shown in FIG. 1, the process cartridge (image forming unit) 7 is disposed below the scanner unit 40. The process cartridge 7 includes a drum cartridge 60 that is detachably mounted within the casing 2. The process cartridge 7 also includes a development cartridge (development unit) 50 that is detachably mounted to the drum cartridge 60. Thus, the process cartridge 7 is constructed from a combination of the cartridges 60 and 50. The process cartridge 7 is detachably mounted to the casing 2.

In the drum cartridge 60, a photosensitive drum 20, a transfer roller 21, and a Scorotron charger 30 are mounted. The development cartridge 50 has a toner box 52 and a development chamber 55 in its casing 51. In the development chamber 55, a supply roller 56, a developing roller 57, and a layer-thickness regulating blade 58 are provided.

The toner box 52 is filled with toner T. According to this embodiment, this toner T is a nonmagnetic single component development agent. The toner T has electrically insulating properties, and is adapted for being electrically charged to a positive polarity. This positive polarity toner can develop electrostatic latent images on the photosensitive drum 20 because the photosensitive drum 20 is electrically charged to a positive polarity by the charging unit 30 as will be described later.

In this example, the toner T is a mixture of toner base particles with an external additive agent, such an silica, that Is added to the outer surface of the toner base particles. The toner base particles have particle sizes in a range of between about 6 to 10 $\mu$m, with average particle diameter of about 8 $\mu$m. The external additive agent is added to the outer surface of the toner to improve fluidity of the toner. In this example, the toner base particles are formed from styrene acrylic resin that is formed into sphere shapes by suspension polymerization, and that is mixed with coloring agent and charge control agent. An example of the coloring agent includes carbon black. Examples of the charge control agent include nigrosine, triphenylmethane, and quaternary ammonium salt.

A rotational shaft 54 is provided in the center of the toner box 52. An agitator 53 is supported on the rotational shaft 54. A toner supply port A is opened at a side wall of the toner box 52. The toner T in the toner box 52 is agitated by the agitator 53 and is discharged through the toner supply port A to the development chamber 55.

The development chamber 55 is provided in fluid communication with the toner box 52 via the toner supply opening A. The toner supply roller 56 is mounted within the development chamber 55 at a location adjacent to the toner supply port A. The toner supply roller 56 is mounted rotatable in a counterclockwise direction as indicated by an arrow in FIG. 1. The developing roller 57 is mounted also within the development chamber 55. The developing roller 57 is disposed in confrontation with the supply roller 56. The developing roller 57 is rotatable also in the counterclockwise direction indicated by the arrow in FIG. 1. The toner supply roller 56 and the development roller 57 ore disposed in abutment contact with each other so that both of the rollers 56 and 57 are slightly compressed.

The development roller 57 is applied with an electric voltage of a predetermined amount with positive polarity, so that the development roller 57 has an electric potential having a predetermined relationship with the electric potential of the photosensitive drum 20. More specifically, the electric potential of the development roller 57 is set lower than the predetermined electric potential of the photosensitive drum 20 attained by the charging by the charger 30 and greater than another electric potential that is occurred on the photosensitive drum 20 when irradiated by a laser beam from the scanning unit 40.

Figure 5:
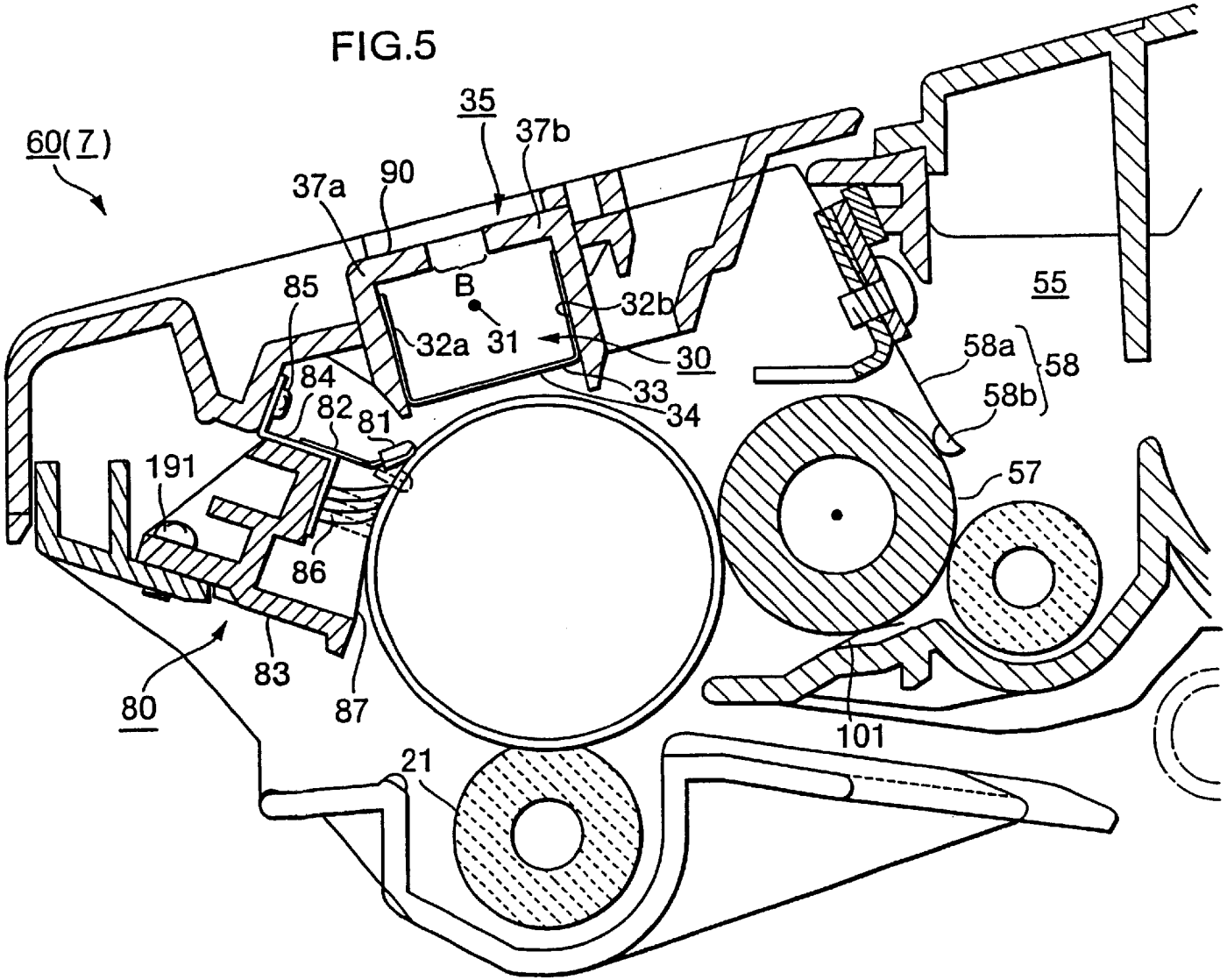
FIG. 5 is a cross-sectional view showing components in the vicinity of the paper dust removal unit and the charge unit according to a modification of the second embodiment.

The layer-thickness regulating blade 58 is disposed within the development chamber 55 at a location adjacent to the development roller 57 so that the layer-thickness regulating blade 58 rubs against the development roller 57. The layer-thickness regulating blade 58 includes a blade body 58*a* (FIG. 5). The blade body 58*a* is formed from a plate spring that is made of metal such as stainless steel. A pressing portion 58*b* (FIG. 5) is formed at a free end of the blade body 58*a*. The pressing portion 58*b* is formed from electrically-insulating silicone rubber.

With this structure, when toner T is discharged from the toner box 52 into the development chamber 55, the toner T is supplied to the development roller 57 by rotation of the toner supply roller 56. The toner is electrically charged to a positive polarity due to friction between the toner supply roller 56 and the development roller 57, while being supplied onto the development roller 57. In association with rotation of the development roller 57, the toner on the development roller 57 passes between the developing roller 57 and the pressing portion 58*b* of the layer-thickness regulating blade 58. The toner is even further charged by friction between the developing roller 57 and the pressing portion 58*b* of the layer-thickness regulating blade 58, while being regulated to a toner layer of a predetermined thickness on the developing roller 57.

The photosensitive drum 20 is mounted in the drum cartridge 60. The drum cartridge 60 is detachably mounted to the side wall of the development cartridge 50 so that the photosensitive drum 20 becomes in confrontation with the development roller 57. The photosensitive drum 20 is rotatably mounted. A drive mechanism (not shown) is provided to drive the photosensitive drum 20 to rotate at a predetermined timing around its rotational axis 20*a* in a clockwise direction indicated by an arrow in FIG. 1.

The photosensitive drum 20 is constructed from a sleeve (drum body) that is electrically grounded, and a photosensitive layer formed on the outer surface of the sleeve. The photosensitive layer is formed from a material that is electrically charged to a positive polarity. For example, the photosensitive layer is made from an organic photoconductor whose main composition is polycarbonate. In this example, the photosensitive drum 20 has a hollow cylindrical sleeve made of aluminum. A photoconductive layer is provided over the outer peripheral surface of the sleeve. The photoconductive layer is made of polycarbonate dispersed with photoconductive resin, and has a predetermined thickness of about 20 micrometers, for example. The sleeve is electrically grounded and is rotatably mounted to the drum cartridge 60.

The Scorotron charger 30 is mounted in the drum cartridge 60 at a location that is above the photosensitive drum 20 and that is separated from the photosensitive drum 20 by a predetermined distance. The Scorotron charger 30 is a positively charging type. The Scorotron charger 30 includes a tungsten wire or other type charge wire, and generates corona discharge therefrom. The Scorotron charger 30 is configured so as to be capable of electrically charging the surface of the photosensitive drum 20 uniformly to a positive polarity. It is noted that the Scorotron charger 30 charges the photosensitive drum 20 to a positive polarity. Accordingly, only an extremely small amount of ozone will be generated.

After the Scorotron charger 30 uniformly charges the surface of the photosensitive drum 20 to a positive polarity, the scanner unit 40 exposes the surface of the photosensitive drum 20 with a laser beam that is modulated by image data. When the electrically-charged surface of the photosensitive drum 20 is exposed to the laser beam, the electric potential at exposed portions is reduced to an electric potential that is lower than the electric potential at non-exposed portions and that is also lower than the electric potential at the developer roller 57. Thus, an electrostatic latent image is formed on the surface of the photosensitive drum 20.

As the development roller 57 rotates, the positively charged toner borne on the development roller 57 is brought into contact with the surface of photosensitive drum 20. As a result, the toner is supplied only to those areas that have their electric potential reduced according to the electrostatic latent image. Thus, the toner is selectively supplied to the surface of the photosensitive drum 20 to develop the electrostatic latent image into a visible toner image. Reversal development is achieved in this manner.

The transfer roller 21 is mounted in the drum cartridge 60 at a position below the photosensitive drum 20 and in confrontation with the photosensitive drum 20. The transfer roller 21 is mounted rotatable in the counterclockwise direction indicated by the arrow in FIG. 1. The transfer roller 21 has a metallic roller shaft covered with a roller made of a resilient conductive foam material such as rubber material (silicone rubber or urethane rubber, for example). The transfer roller 21 is applied with a transfer bias that has a polarity opposite to that of the photosensitive drum 20. Accordingly, the positively-charged toner borne on the photosensitive drum 20 is electrostatically attracted in a direction toward the transfer roller 21.

A part of the sheet transport path 6 downstream from the register rollers 12, 13 passes through a predetermined transfer position that is defined between the photosensitive drum 20 and the transfer roller 21. Accordingly, the sheet of paper P passes through the predetermined transfer position between the photosensitive drum 20 and the transfer roller 21. With this arrangement, the visible toner image borne on the photosensitive drum 20 is transferred from the photosensitive drum 20 to a sheet of paper P that is being conveyed between is the photosensitive drum 20 and the transfer roller 21.

As shown in FIG. 1, the fixing unit 70 is disposed downstream from the process cartridge 7 along the sheet transport path 6 in the sheet transport direction S. The fixing unit 70 includes a thermal roller 71 and a pressing roller 72 that is pressed against the thermal roller 71. The thermal roller 71 is for thermally fixing toner onto a sheet of paper P as the sheet of paper P passes between the pressing roller 72 and the thermal roller 71.

A pair of transport rollers 73 are provided downstream from the fixing unit 70 in the sheet transport direction S. The sheet of paper P is therefore transported by the transport rollers 73 to a pair of discharge rollers 74. When the sheet of paper P reaches the pair of discharge rollers 74, the sheet of paper P is discharged by the discharge rollers 74 onto a discharge tray 75 that is provided on the upper surface of the casing 2.

With the above-described structure, during one image forming procedure, the charge unit 30 uniformly charges the surface of the photosensitive drum 20 to a predetermined electric potential (which will be referred to as "original electric potential" hereinafter) with a positive polarity. When the laser scanner unit 40 irradiates the surface of the photosensitive drum 20 with laser light L that has been modulated according to image information, the electric potential of the photosensitive drum drops, at its laser beam-exposed region, from the original potential to an electric potential lower than that of the development roller 57. Thus, a corresponding electrostatic latent image is produced on the surface of the photosensitive drum 20. The electrostatic latent image is made from an image area corresponding to the laser-exposed region having the reduced electric potential. A non-image area corresponds to an unexposed region that maintains the original electric potential. The positively-charged toner supported on the development roller 57 is electrostatically attracted toward the electrostatic latent image area having the reduced electric potential. Thus, the electrostatic latent image is developed into a visible toner image.

Rotation of the photosensitive drum 20 conveys the visible toner image formed thereon in the rotating direction (clockwise direction in the figure) to the transfer position where the transfer roller 21 abuts against the photosensitive drum 20. At the transfer position, the visible toner image is transferred onto a sheet of paper P that has been supplied from the sheet feeder unit 4. Because the polarity of the transfer bias applied to the transfer roller 21 is opposite to those of the photosensitive drum 20 and of the toner, the visible toner image is transferred from the photosensitive drum 20 to the sheet of paper P that is being conveyed between the photosensitive drum 20 and the transfer roller 21.

Next, the sheet of paper P is transported to the fixing unit 70 and is further transported while being sandwiched between the thermal roller 71 and the pressing roller 72. Thus, the visible toner Image is pressed and heated on the sheet of paper P and fixed onto the sheet P. The sheet P is discharged onto the discharge tray 75 at the upper surface of the laser beam printer 1 by the transport rollers 73 and the discharge rollers 74. This completes one cycle of image forming process.

According to the predetermined cleanerless method, when some residual toner remains on the surface of the photosensitive drum 20 after the transfer process during one image forming cycle, the residual toner will be collected by a the developing roller 57 during the next image forming cycle, and will be reused for subsequent developing processes.

More specifically, during each cycle of image forming process, some toner remains on the photosensitive drum 20 after the toner image has been transferred onto the sheet of paper P. At the next image forming cycle, rotation of the photosensitive drum 20 first brings the residual toner into confrontation with the charge unit 30. When the charge unit 30 uniformly charges the photosensitive drum 20 back to the original electric potential, the residual toner is also charged to the original electric potential. Then, the laser beam exposure unit 40 irradiates the photosensitive drum 20 with a laser beam that is modulated corresponding to image information. As a result, the electric potential at the exposed area drops from the original potential, while the electric potential at the non-exposed area maintains the original potential. Further rotation of the photosensitive drum 20 brings the residual toner into confrontation with the development roller 57. Toner on the development roller 57 is transferred onto the exposed area, and therefore a part of the residual toner that exists on the exposed area will be buried in the newly-supplied toner. A remaining part of the residual toner that is located on the non-exposed area of the photosensitive drum 20 are electrostatically attracted to the development roller 57. Thus, the development roller 57 develops the electrostatic latent image while simultaneously collecting the residual toner on the photosensitive drum 20. According to this cleanerless process, there is no need to provide a cleaner device for cleaning residual toner There is no need to provide a separate vessel- for accumulating waste toner. Configuration of the printer 1 can therefore be simplified and made compact. Also, cost for producing the printer 1 can be reduced.

It is noted that in the laser printer 1 having the above-described structure, the surface of the photosensitive drum 20 directly contacts the sheet of paper P. Therefore. paper dust easily clings to the surface of the photosensitive drum 20. If the paper dust is allowed to remain on the surface of the photosensitive drum 20 together with the residual toner, the paper dust will possibly be collected by the developing roller 57 together with the residual toner This can result in formation of detective images during the subsequent image forming cycles.

In order to solve this problem, according to the present embodiment, the laser printer 1 is provided with a paper-dust removing device 80. The paper-dust removing device 80 serves to remove paper dust that clings to the photosensitive drum 20, As shown in FIG. 2, the paper-dust removing device 80 is disposed downstream from the transfer roller 21 and upstream from the charging unit 30 and the development roller 57 with respect to the rotational direction (clockwise direction in the drawing) of the photosensitive drum 20. The paper-dust removing device 80 is located in contact with the surface of the photosensitive drum 20.

Figure 2:
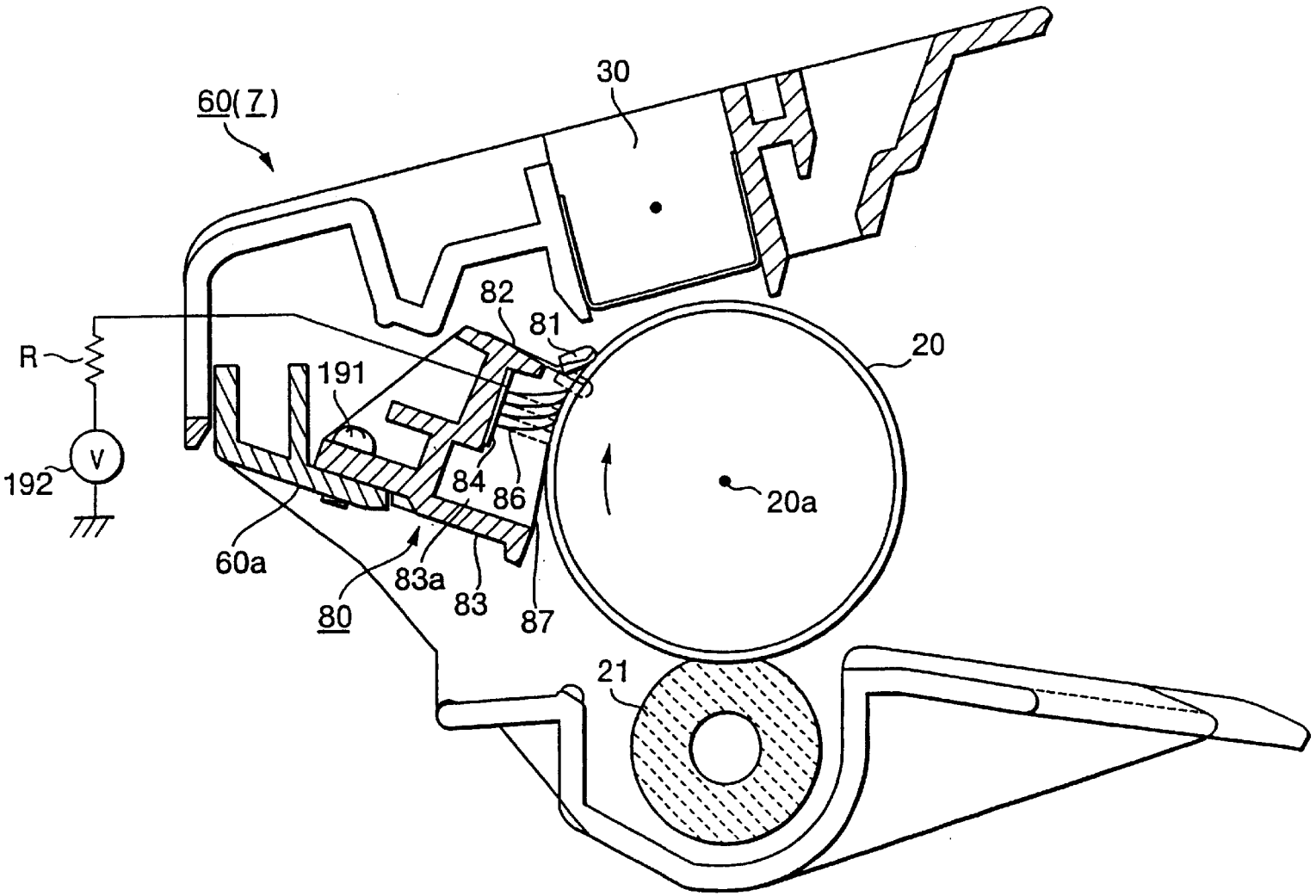
FIG. 2 is an enlarged view showing components in the vicinity of a paper dust removal unit in the image forming apparatus of FIG. 1.

As shown in FIG. 2, the paper-dust removing device 80 has a casing or holder 83. A urethane sheet 82 is attached, at its rear edge, to an upper surface of the holder 83. A front edge of the urethane sheet 82 is covered by a non-woven fabric 81. The non-woven fabric 81 is impregnated with oil agent.

The holder 83 is formed in an elongated shape that extends parallel to the photosensitive drum 20. The holder 83 has a length that is substantially equal to the length of the photosensitive drum 20. The holder 83 is fixed, at its both lengthwise ends, by a pair of screws 191 to the wall 60*a* of the drum cartridge 60 that supports the photosensitive drum 20 so that the holder 83 will confront the photosensitive drum 20.

The holder 83 has a chamber 83*a* for collecting paper dust removed from the photosensitive drum 20. The chamber 83*a* is opened at its front side confronting the photosensitive drum 20. A urethane film 87 is attached to a lower edge of the holder 83 to cover a lower half portion of the opening of the chamber 83*a*. One lower edge of the urethane film 87 is attached to the holder 83 by a two sided adhesive tape so that the upper free edge of the urethane film 87 be in abutment contact with the photosensitive drum 20. The urethane film 87 is for preventing paper dust removed from the photosensitive drum 20 from falling out of the chamber 83*a*.

The urethane sheet 82 is a sheet-shaped member made from urethane rubber. The urethane sheet 82 has a hardness of 92 degrees Hs (92° Hs) according to JIS K-6301.

The non-woven fabric 81 is also formed to have the length substantially equal to the length of the photosensitive drum 20. The non-woven fabric 81 is attached to the front edge of the urethane sheet 82 using a two sided adhesive tape. That is, the non-woven fabric 81 is folded in half and adhered to the front edge of the urethane sheet 82.

According to the present embodiment, the non-woven fabric sheet 81 is formed from fibers entangled into an integral mass. In the non-woven fabric sheet 81, constituent fibers are arranged in an extremely random manner, and therefore fine paper dust can be properly caught up in between the fibers.

The fiber material of the non-woven fabric sheet 81 can include polyester fiber, polyamide fiber. acrylic fiber, and the like. The non-woven cloth sheet 81 is impregnated with at least one of mineral oil, synthetic oil, and the like.

The urethane sheet 82 is adhered to the upper surface of the holder 83 at a location that if the photosensitive drum 20 is not present, the non-woven fabric 81 on the front edge of the urethane sheet 82 will reach, as indicated by a dotted line in FIG. 2, to the position where the photosensitive drum 20 is to be disposed. When the photosensitive drum 20 is positioned as shown in FIG. 2, the non-woven fabric 81 abuts against the photosensitive drum 20, and the urethane sheet 82 bends as indicated by the solid line in FIG. 2. Thus, the non-woven fabric 81 contacts the photosensitive drum 20 along its entire length by the resilient force of the urethane sheet 82. The urethane sheet 82 bends in the directions in which the photosensitive drum 20 is driven to rotate.

The paper dust removal unit 80 further includes a conductive plate 84 which is attached to the inner surface of the side wall of the holder 83 that confronts the photosensitive drum 20. The conductive plate 84 is made from a conductive material such as aluminum. A brush member 86 is supported on the conductive plate 84. The brush member 86 is formed from a sheet on which fibers are embedded. The sheet of the brush member 86 is provided on the conductive plate 84 as shown in FIG. 2.

The conductive plate 84 is electrically connected to a fixed voltage source 192 via a resistor R so that the conductive plate 84 and the brush member 86 are applied with an electric voltage of a fixed amount.

In the present embodiment. chemical fiber such as acrylic fiber is used as the fiber member of the brush member 86. A representative example of the acrylic fiber includes KANEKALON (trade name) manufactured by KAHEKA Corporation. According to experiments, it was confirmed that paper dust could be properly captured when the acrylic fiber was used. In this example, the acrylic fiber in subjected to a degreasing process before being provided on the conductive plate 84. The degreasing process is for removing oil or the like adhered to the surface of the fibers, thereby preventing resistance of the fibers from dropping when environmental conditions and the like change. The acrylic fiber is subjected to the degreasing processes because according to results of experiments, it was confirmed that the degreasing processes could increase and stabilize the resistance value of the acrylic fibers.

Table 1 below shows the voltage-current relationship attained by acrylic fibers of the present embodiment which have been subjected to the degreasing processes, and the voltage-current relationship for acrylic fibers of a comparative example which have not been subjected to the degreasing process. The voltage-current relationship 18 a relationship between application voltages applied to the acrylic fibers and the amounts of currents flowing in the acrylic fibers. The voltage-current relationship therefore indicates resistance values of the acrylic fibers.

TABLE 1

| APPLIED VOLTAGE (kv) | <DEGREASING> Current Value | <NO DEGREASING> Current Value |
|---|---|---|
| 0 | 0 | 0 |
| 0.5 | | 1.4 |
| 1 | 0.7 | 2.9 |
| 1.5 | | 7.8 |
| 2 | 2.2 | |
| 2.5 | | |
| 3 | 7.1 | |

As shown in, Table 1, when the degreasing processes were not performed, currents of 1.40 $\mu$A. 2.9 $\mu$A, and 7.8 $\mu$A flowed through the acrylic fibers when voltages of 0.5 kV, 1.0 kv. and 1.5 kV. respectively, were applied to the acrylic fibers. In contrast to this, when the degreasing processes were performed, a current of 0.7 $\mu$A flowed through the acrylic fibers when a voltage of 1.0 kV was applied. This is one half of the value of when the degreasing processes were not performed. Further, a current of 2.20 $\mu$A was observed when a 2.0 kV voltage was applied, and a current of 7.1 $\mu$A was s observed when a 3.0 kV voltage was applied. In this way, the degreasing processes increase the resistance value of the acrylic fibers. In the present embodiment, the resistance value of the brush member 86 is set to $10^8$ Ω to $10^{10}$ Ω by subjecting the acrylic fibers to the degreasing processes.

The voltage source 192 is set to supply an electric voltage with positive polarity of an amount higher than the surface potential of the unexposed portion of the photosensitive drum 20 so that discharge from the brush member 86 to the photosensitive drum 20 will be suppressed to the minimum even when the surface potential of the photosensitive drum 20 fluctuates. The voltage is applied by a fixed voltage control. That is, the voltage source 192 is controlled ON and OFF to apply the fixed amount of voltage (2 kilovolts, in this example) to the brush member 86.

Thus, according to the present embodiment, the brush member 86 is formed from a brush made from acrylic resin that has not been subjected to conductivity-enhancing processes. The brush member 86 is attached to the conductive plate 84. The resistor R is provided in series with the conductive plate 84 and the fixed power source 192. The fixed power source 192 applies the predetermined high voltage to the conductive plate 84.

It is noted that paper dust that clings to the surface of the photosensitive drum 20 after the transfer process includes large fiber-shaped paper dust and finer paper dust. The large fiber-shaped paper dust is caught in the brush member 86 itself or is trapped on the brush member 86 by operation of the electric field resulting from the application of the high voltage to the brush member 86. The finer paper dust is caught up by the non-woven cloth 81.

Because the urethane sheet 82 has a low hardness, the non-woven fabric 81 will softly contact the photosensitive drum 20 even when pressed by resilient force of the urethane sheet 82. Experiments were performed to measure, with a dial tension gauge, the pressing force of the non-woven fabric 81 that is effected against the photosensitive drum 20 by the urethane sheet 82. The pressing force was measured as a low value of only 2.5 gf/cm.

Thus, the pressing force of the non-woven fabric 81 against the photosensitive drum 20 is extremely small. However, paper dust can be caught up in the fibers constituting the non-woven fabric 81. Accordingly, the paper dust can be properly removed even with this low pressing force. The non-woven cloth 81 can properly remove both the fibers component and the filler component of the paper dust. Because the pressing force of the non-woven fabric 81 against the photosensitive drum 20 is set to the low value, the surface of the photosensitive drum 20 will not be damaged by the fibers component of the paper dust and also filming will not occur by the filler component of the paper dust.

A detailed explanation will be given for how paper dust generated from the sheets of paper P causes poor images. The main component of paper is pulp fiber, which is cellulose extracted from coniferous or broadleaf trees. Paper further includes tiller material that makes the paper opaque or white: a sizing agent to reduce absorption of ink by the paper to prevent ink from spreading excessively through the paper; and a fixing agent that enhances absorption of the sizing agent by pulp fiber. Especially, acidic paper usually contains talc or clay as a filler, rosin size as the sizing agent, and aluminum sulfate as the fixing agent.

Of these materials, pulp fiber and talc filler are the materials that especially adversely affect the electrophotographic process. If the pulp fiber enters the developing cartridge 50 that uses nonmagnetic single component toner T, the pulp fiber can be caught between the layer-thickness regulating blade 58 and the developing roller 57, and will damage the layer-thickness regulating blade 58 or the developing roller 57. Additionally, toner will possibly cling to the pulp fiber. The pulp fiber attached with the toner will possibly pass between the development roller 57 and the layer-thickness regulating blade 58 and then be transferred to the surface of a sheet of paper P. If this sheet of paper P passes through the fixing process and la discharged onto the discharge tray 75 with the pulp fiber attached thereon, the pulp fiber will appear as an undesirable black speck in white areas on the sheet of paper.

The talc has a strong tendency to be electrically charged to a negative polarity. Accordingly, when positive polarity toner is used, if talc mixes into the developing cartridge 50, then the charge amount of the toner will be reduced. This will cause fogging on resultant printed images. On the other hand, when negative polarity toner is used, then talc can result in fogging or even if fogging does not occur, the charged amount of toner might become too high so that the density of resultant images will drop.

However, as described above, according to the present embodiment, a voltage having the same, positive polarity as the toner is applied to the brush member 86. For this reason, the pulp fiber of the paper dust can be reliably trapped by the brush member 86 and reliably prevented from entering the developing unit 50. This is because paper dust is naturally charged to a negative charge. In addition, the paper dust is charged to opposite polarity of toner during transfer processes. Therefore, the paper dust has a strong negative polarity charge after the transfer stage. The brush member 86 is applied with a voltage at the same polarity as the toner, thereby generating electro field. Accordingly, the paper dust can be reliably caught up in the brush member 86 by the electric field.

The non-woven fabric 81 is pressed against the photosensitive drum 20 by resilient force of the low hardness urethane sheet 82. Accordingly, the pressing force of the non-woven fabric 81 against the photosensitive drum 20 is suppressed to the extremely low value of 2.5 gf/cm. Therefore, the hard pulp fiber caught by the non-woven fabric 81 does not damage the surface of the photosensitive drum 20. Filler also caught by the non-woven fabric 81 does not generate filming on the photosensitive drum surface.

Accordingly, paper dust can be reliably prevented from mixing in with toner in the developing unit 50 and defective images can be prevented.

Further, according to the present embodiment, the voltage applied to the brush member 86 is the same polarity as the charge of the toner. Therefore, the brush member 86 only catches paper dust and does not catch up toner. Moreover, polymerized toner produced by polymerization is used in the present embodiment. The polymerized toner has toner base particles formed to substantially spherical shape and so has high fluidity. Because of this high fluidity, extremely high percentage of the toner is transferred during the transfer operations. and very little residual toner remains on the photosensitive drum 20 afterward. Even if little residual toner remains on the photosensitive drum 20, the residual toner is unlikely to cling to the unwoven cloth 81 and can be reliably returned to the developing unit 50.

Thus, the paper-dust removing device 80 according to the present embodiment can reliably remove paper dust including fiber components and filler components without generating filming and without damaging the surface of the photosensitive drum 20. Therefore, pulp fibers and talc will not enter the developing cartridge 50. Further, pulp fibers will not be transferred to recording sheets P. As a result, defective images by fogging and staining of the recording sheets can be reliably prevented. Experiments were performed to operate the laser printer 1 to print images consecutively on 15,000 acidic sheets of paper. It was proved that the configuration of the present embodiment provided good quality images without any damage to the photosensitive drum 20 and without any filming.

It was confirmed that good images were formed without generation of ununiform charges on the photosensitive drum 20 even when a high voltage of 2 kV was applied to the brush member 86. This is because the acrylic fibers that make up the brush member 86 was not subjected to any conductivity-enhancing processes, and therefore the resistance of the acrylic fibers was not decreased. In other words, because the brush member 86 has a high resistance, discharge from the brush member 86 to the photosensitive drum 20 can be reduced to a minimum even if a high voltage is applied to the brush member 86. Ununiform charges on the photosensitive drum 20 can be suppressed.

Further, according to the present embodiment, the brush member 86, whose resistance is high as described above, is applied by the fixed voltage control with a voltage higher than the surface potential at an unexposed portion of the photosensitive drum 20. Therefore, even if the surface potential of the photosensitive drum 20 changes because of changes in the transfer condition, such as type of paper or ambient conditions, the potential of the brush member 86 would be always higher than the surface potential of the photosensitive drum 20. Therefore, the brush member 86 can always properly catch paper dust charged to the opposite polarity of the toner.

First experiments were performed to investigate the effects of the resistance value of the brush member 86 on the capacity of the brush member 86 to remove paper dust and on the ununiformity of the surface potential on the photosensitive drum 20. Also, second experiment were performed to investigate the influence of voltage value applied to the brush member 86 on the capacity of the brush member 86 to remove paper dust and the ununiformity of surface potential on the photosensitive drum 20. The results of these experiments will be explained here.

Table 2 shows results of the first experiments.

TABLE 2

| Resistance Value of Brush | Capacity to Remove Paper Dust (Determined by Observing the Photosensitive Drum) | Non-Uniformity in Potential on Photosensitive Drum after Charging |
|---|---|---|
| $10^7\Omega$ | Δ (Slight Amount of Paper Dust Past) | X (Great Non-Uniformity) |
| $10^8\Omega$ | ○ (Almost No Paper Dust Observed) | Δ (Slight Non-Uniformity) |
| $10^9\Omega$ | ⊙ (No Paper Dust Observed) | ○ (No Problem) |
| $10^{10}\Omega$ | ○ (Almost No Paper | ○ (No Problem) |
| $10^{11}\Omega$ | X (Fairly Large Amount of Paper Dust Past) | ○ (No Problem) |

It should be noted that in the first experiments, a fixed voltage of 2 kV (kilovolts) was applied to the brush is member 86. The capacity of the brush member 86 to remove paper dust was determined by visually confirming the amount of paper dust on the photosensitive drum 20. The ununiformity of charge was evaluated by nonuniformity in density of printed images.

As shown in, Table 2, when the brush member 86 had a resistance value of $10^7$ Ω), a slight amount of paper dust was observed on the photosensitive drum 20 after the photosensitive drum 20 passed by the contact position where the photosensitive drum 20 contacts the brush member 86. Also, large nonuniformity in surface potential was observed on the photosensitive drum 20 after charge operations by the charger 30. The nonuniformity is believed to occur for the following reason. That is, because the resistance value of the brush member 86 is not sufficiently high, the voltage applied to the brush member 86 discharges onto the photosensitive drum 20. As a result, the potential difference between the brush member 86 and the photosensitive drum 20 drops to an insufficient value. Discharge occurs nonuniformly, so that such ununiformity in surface potential is generated on the photosensitive drum 20.

When the brush member 86 had a resistance of $10^8$ Ω, almost no paper dust was observed on the photosensitive drum 20 after passed by the contact position. A slight amount of ununiformlty in surface potential was observed on the photosensitive drum 20 after charge operations. Reason for these results is believed to be that because the resistance value of the brush member 86 is high, very little discharge occurs from the brush member 86 to the photosensitive drum 20, and the potential difference between the photosensitive drum 20 and the brush member 86 is maintained to a sufficiently large value.

When the brush member 86 had a resistance value of $10^9$ Ω, no paper dust was observed on the photosensitive drum 20. When the resistance value was $10^{10}$ Ω, then only a slight amount of paper dust was observed. With either these resistance values, no nonuniformity in surface potential was observed on the photosensitive drum 20. The reason for this is thought to be that because the resistance of the brush member 86 is sufficiently high, almost no discharge occurs from the brush member 86 to the photosensitive drum 20. As a result, sufficiently high potential difference between the brush member 86 and the photosensitive drum 20 can be maintained.

When the resistance value of the brush member 86 was set to $10^{11}$ Ω, a fairly large amount of paper dust was observed on the photosensitive drum 20. However, absolutely no nonuniformity in surface potential was observed on the photosensitive drum 20. The reason is thought to be that because the resistance value of the brush member 86 is extremely high, discharge did not occur on the brush member 86 to the photosensitive drum 20. However, because the resistance value is too high, the voltage of the brush member 86 cannot reach a sufficiently high level. so that a sufficiently high potential difference cannot be achieved between the brush member 86 and the photosensitive drum 20.

Table 3 shows results of the second experiments. In the second experiments, the brush member 86 was provided with a resistance value of $10^9$ Ω.

TABLE 3

| Applied Voltage | Capacity to Remove Paper Dust (Determined by Observing the Photosensitive Drum) | Non-Uniformity in Potential on Photosensitive Drum after Charging |
|---|---|---|
| 1kV | X (Fairly Large Amount of Paper Dust Past) | ○ (No Problem) |
| 1.5kV | X (Sometimes Paper Dust was Seen) | ○ (No Problem) |
| 2kV | ⊙ (No Paper Dust Observed) | ○ (No Problem) |
| 3kV | ⊙ (No Paper Dust Observed) | ○ (No Problem) |
| 4kV | ⊙ (No Paper Dust Observed) | Δ (Slight Non-Uniformity) |

As shown in, Table 3, when a voltage of 1 kV was applied to the brush member 86, a considerably large amount of paper dust was observed on the photosensitive drum 20. However, no nonuniformity in surface potential was observed on the photosensitive drum 20. There is thought to be the following reason. That is, the surface potential of the photosensitive drum 20 is normally 400V to 600V after transfer operations. Therefore, when a voltage of 1 kv is applied to the brush member 86, then the potential difference between the brush member 86 and the photosensitive drum 20 will be about 400V to 600V. Such difference value is not sufficient for removing paper dust. However, because this potential difference is small, discharge does not occur from the brush member 86 to the photosensitive drum 20, so that nonuniformity in surface potential is not developed on the photosensitive drum 20 after charge operations.

When the voltage to the brush member 86 was set to 1.5 kV, there were some instances where no paper dust was observed. However, paper dust was still observed frequently. No nonuniformity in surface potential was observed on the photosensitive drum 20. When a voltage of 1.5 kV is applied to the brush member 86, potential difference of 0.9 kV to 1.1 kV is developed between the brush member 86 and the photosensitive drum 20. Keeping this in mined. It is believed that these experimental results were obtained because of the following reason. That is, some boundary value of potential difference which is sufficient for removing paper dust is within the range of between 0.9 kV and 1.1 kV. When the potential difference exceeds this boundary values then no paper dust is observed. When the potential difference is below the boundary value, then paper dust is observed. Also, with the potential difference within the above range. discharge does not occur from the brush member 86 to the photosensitive drum 20, so that nonuniformity in surface potential does not occur on the surface of the photosensitive drum 20.

Although not shown in, Table 3. several experiments were further performed with voltage values of 1.4 kV and 1.3 kV. Paper dust was sometimes observed and sometimes not when the voltage was 1.4 kV. However, paper dust was always observed when the voltage was 1.3 kV. The potential difference between the brush member 86 and the photosensitive drum 20 is in the range of between 0.8 kV and 1.0 kV when the brush member 86 is applied with a voltage of 1.4 kV. The range of potential difference is from 0.7 kV to 0.9 kV when a 1.3 kV voltage was applied. From these experimental result, it is believed that the boundary value of the potential difference sufficient for removing paper dust is 1.0 kV.

When the voltage applied to the brush member 86 was 2.0 kV or 3.0 kV, absolutely no paper dust was observed. Also, no nonuniformity in surface potential was observed. These experimental result was believed to be because when voltage is 2.0 kV or 3.0 kV, the potential difference between the brush member 86 and the photosensitive drum 20 in in the range between 1.4 kV to 1.6 kV or 2.4 kV to 2.6 kV, respectively, which is above the boundary value of 1.0 kV discussed above. Accordingly, potential difference sufficient for removing paper is developed between the brush member 86 and the photosensitive drum 20, so that paper dust is not observed. Also, when the voltage is 2.0 kV to 3.0 kV, discharge does not occur from the brush member 86 to the photosensitive drum 20, so no nonuniformity in surface potential is generated on the photosensitive drum 20.

When a voltage of 4.0 kV was applied to the brush member 86, absolutely no paper dust was observed on the photosensitive drum 20. However, slight nonuniformity in surface potential was observed on the photosensitive drum 20. The reason for these experimental results is thought to be is that when a voltage of 4.0 kV is applied to the brush member 86, the potential difference between the brush member 86 and the photosensitive drum 20 is about 3.4 kV to 3.6 kV, which is above the border value described above. Accordingly, there is a sufficient potential difference, so no paper dust is observed. However, when a voltage is as high as 4.0 kV, then it is believed that discharge occurred from the brush member 86 to the photosensitive drum 20, which results in nonuniformity in surface potential on the photosensitive drum 20.

From these results described above, it can be determined that the resistance value of the brush member 86 is desirably between in a range between $10^8$ Ω and $10^{10}$ Ω. In particular, it is desirable to set the resistance value of the brush member 86 to $10^9$ Ω. According to the present embodiment, therefore, production costs of the image forming apparatus 1 can be reduced, paper dust can be effectively removed, and nonuniformity in surface potential on the photosensitive drum can be effectively prevented.

It can also be determined that paper dust can be efficiently removed and nonuniformity in surface potential on the photosensitive drum can be effectively prevented when the brush member 86 is applied with voltage that provides potential difference of 1 kV or greater between the brush member 86 and the photosensitive drum 20. That is to say, as long as the voltage applied to the brush member 86 was equal to or greater than the surface potential of unexposed portions of the photosensitive drum 20. a sufficiently high potential difference, required for reliably removing paper dust, could always be obtained regardless of whether the surface potential on the photosensitive drum 20 changes or not.

Even when such a high voltage is applied to the brush member 86, electric currents flowing through the brush member 86 can be restricted to an appropriate value because the brush member 86 has one of the high resistance values described above. Discharge from the brush member 86 to the photosensitive drum 20 can be prevented and nonuniformity in surface potential can be prevented.

Because nonuniformity in surface potential is not generated, the charge remove lamp, such as an erase lamp, can be dispensed with so that the cost of the device can be reduced. Also, the configurations can be simplified.

It is noted that in the above-described example, the fibers of the brush member 86 to subjected to the degreasing process, before being attached to the conductive plate 84, in order to prevent the resistance value of the fiber member from lowering due to changes in the environmental conditions, and the like. However, it is unnecessary to subject the fibers to the degreasing process.

Fibers of the brush member 86 should not be subjected to any conductivity-enhancing processes, such as the process for dispersing carbon particles through the fibers or the process for coating metal onto the fibers. before the brush member 86 is attached onto the conductive plate 84.

If the brush member 86 has some local area that has low resistance ($10^5$ Ω or less) and that contacts the surface of the photosensitive drum 20, electric currents will concentrate to flow through this local area, thereby generating a discharge to the photosensitive drum 20. In this case, a resultant image formed on a sheet of paper by the photosensitive drum 20 will suffer from an undesirable white band that extends in the conveying direction of the paper.

Chemical fibers, such as acrylic fibers, do not have any local areas, whose resistance is equal to or lower than $10^5$ Ω or less, as long as the chemical fibers are not subjected to any processes including the conductivity-enhancing processes. Accordingly, the chemical fibers can be used as the brush member as if they are not subjected to any processes including the conductivity-enhancing processes. By subjecting the chemical fibers to the degreasing process, it is possible to prevent the resistance of the chemical fibers from lowering even when the environmental conditions change.

In the present embodiment, the resister R is provided in series between the brush member 86 and the voltage source 192. Therefore, the current flowing through the brush member 86 can be restricted to a predetermined upper limit value. Discharges from the brush member 86 to the photosensitive drum 20 can be reduced so that unevenness of charge on the photosensitive drum 20 can be reliably prevented. However, other various types of current limiter can be used to restrict the amount of currents flowing through the brush member 86 to a predetermined upper limit.

Second Embodiment

Next, a second embodiment of the present invention will be described while referring to FIGS. 3–10. Components employed in the second embodiment having the same configuration as those of the first embodiment are designated with the same numbering.

Figure 3:
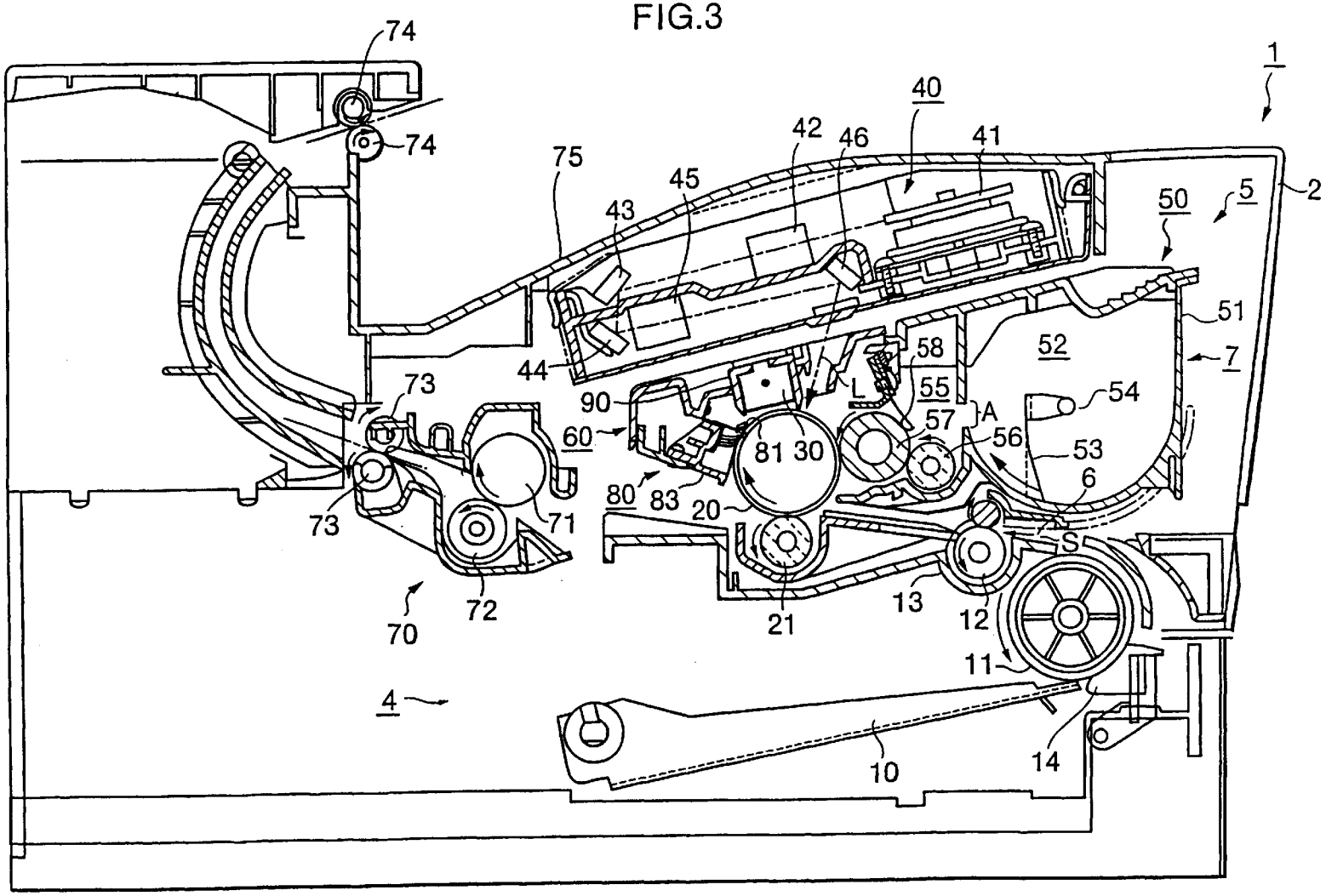
FIG. 3 is a cross-sectional view showing schematic configuration of an image forming apparatus according to a second embodiment.

According to the present embodiment, as shown in FIG. 3, the voltage source 192 is not mounted in the image forming apparatus 1. Instead, the charging unit 30 is used to apply an electric voltage to the brush member 86.

Figure 4A:
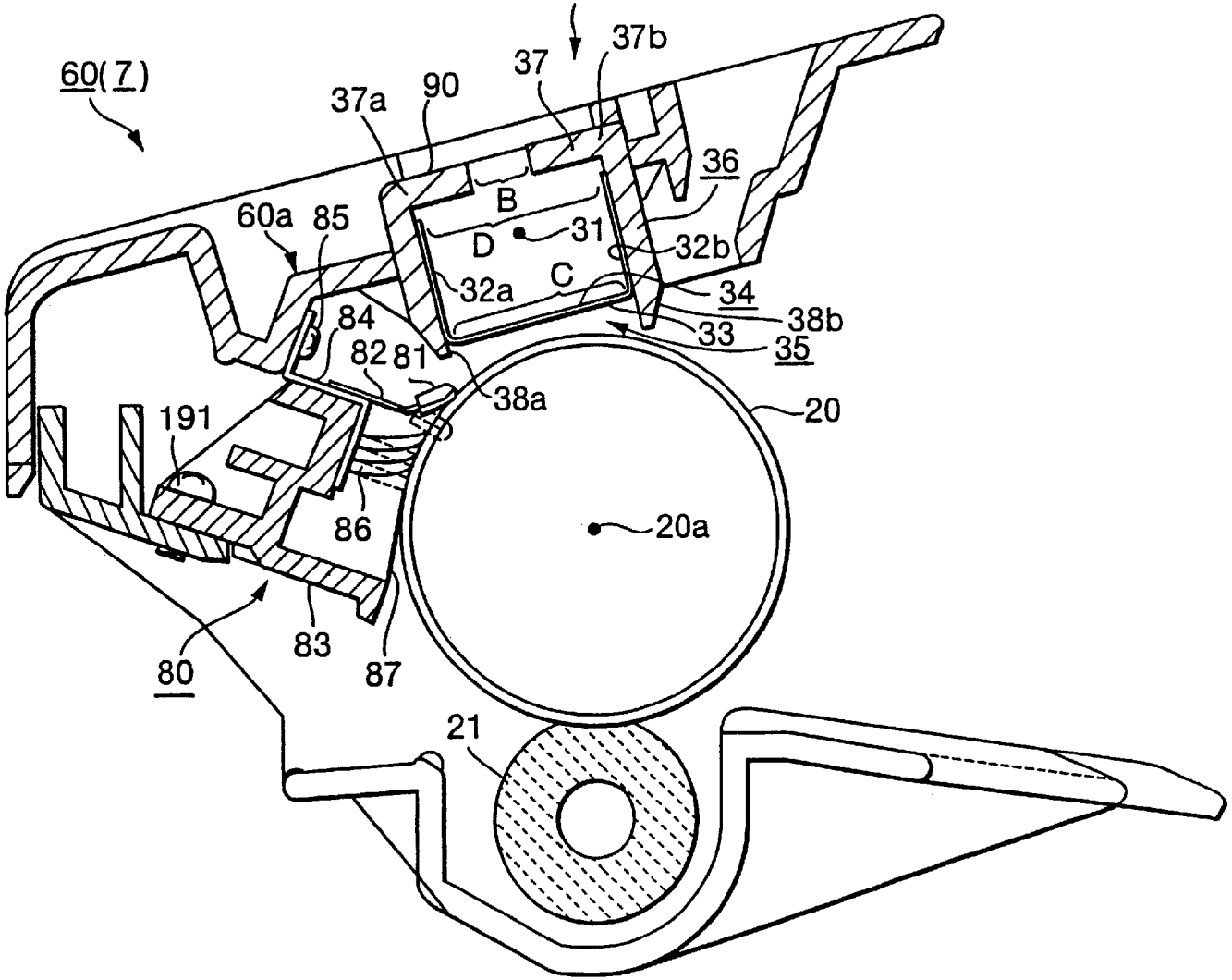
FIG. 4(A) is an enlarged view showing components in the vicinity of the paper dust removal unit and the charge unit in the image forming apparatus of FIG. 3.
Figure 4:
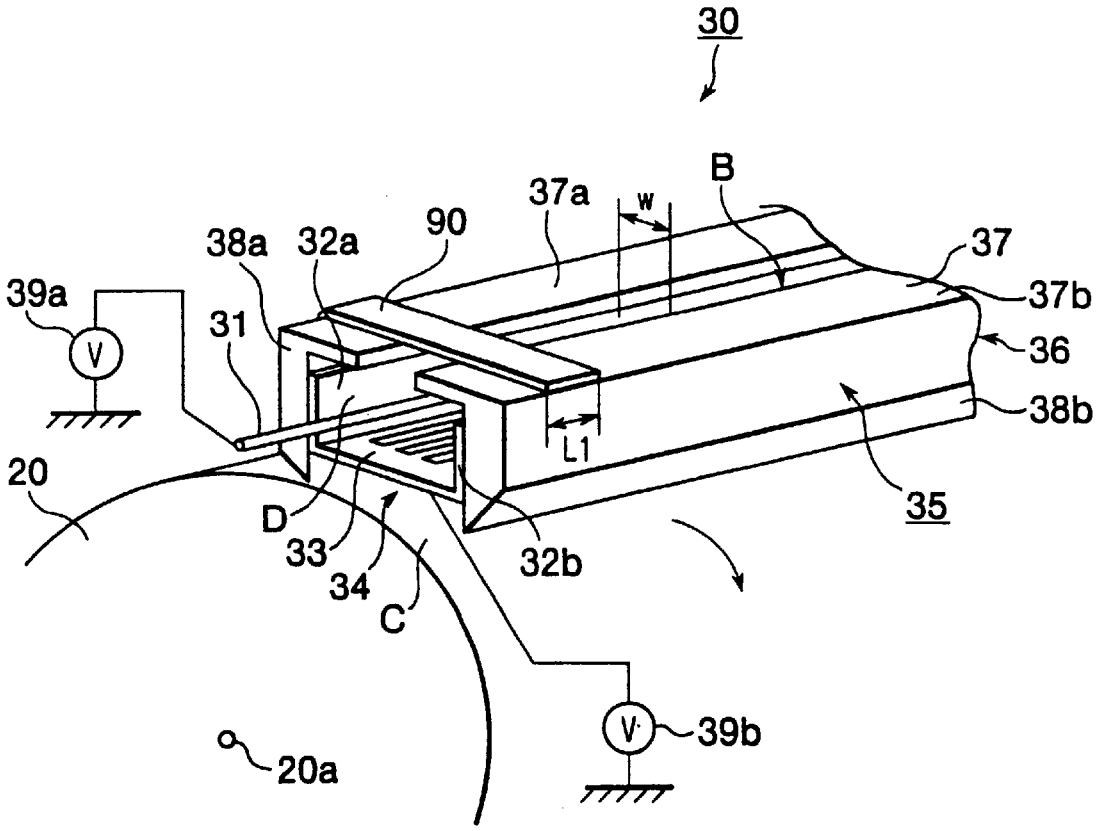
FIG. 4(B) is a perspective view showing the charge unit of FIG. 4(A)

As shown in FIGS. 4(A) and (B), the charge unit 30 includes a shield casing 35. The shield casing 35 is supported to the wall 60*a* of the drum cartridge 60. The shield casing 35 is elongated in a direction parallel to the rotational axis 20*a* of the photosensitive drum 20. A corona wire 31 is provided within the shield casing 35. The corona wire 31 extends also in the elongated direction of the shield casing 35, that is, parallel to the rotational axis 20*a* of the photosensitive drum 20. The corona wire 31 is made from tungsten of, for example, 30 μm to 100 μm thick. The corona wire 31 is applied with a predetermined voltage of positive polarity from a voltage source 39*a*.

The shield casing 35 is constructed from a support member 36 made of electrically-insulating material. The support member 36 is an elongated structure that extends also along the rotational axis 20*a* of the photosensitive drum 20. The support member 36 has a base wall 37 and a pair of side walls 38*a* and 38*b*. An opening B is formed through the base wall 37, thereby dividing the base wall 37 into a pair of base sections 37*a* and 37*b*. The pair of side walls 38*a* and 38*b* extend from the pair of base sections 37*a* and 37*b*, respectively. The support member 36 also has another opening C that is defined between the tip ends of the side walls 38*a* and 38*b* and that is located in confrontation with the photosensitive drum 20.

A metal shield 34 is provided covering the opening C of the support member 37. The metal shield 34 has a grid electrode portion 33 and a pair of shield portions 32*a* and 32*b*. The grid electrode portion 33 and the pair of shield portions 32*a*, 32*b* are integrated together into the metal shield 34. The metal shield 34 is attached to the support member 36, with the pair of shield portions 32*a* and 32*b* being fixed to the pair of side walls 38*a* and 38*b*, respectively. The grid electrode portion 33 covers the opening C. The grid electrode portion 33 is formed with a plurality of slits. The metal shield 34 has an opening D that is defined between the tip ends of the pair of shield portions 32*a* and 32*b* and that confronts the base wall 37 of the support member 36. The metal shield 34 is applied with a predetermined grid bias voltage from another voltage source 39*b*.

According to the present embodiment, a charge catching electrode 90 is provided to the outer surface of the base wall 37. The charge catching electrode 90 is of a plate shape. The charge catching electrode 90 spans across the opening B as shown in FIG. 4(B).

As shown in FIG. 4(A), the charge catching electrode 90 extends along the outer surface of the side wall 38*a*, and further extends to finally reach the paper dust removal unit 80. The end of the extended part of the charge catching electrode 90 and one end of the conductive plate 84 are fastened together onto the frame 60*a* of the drum cartridge 60 by a screw 85. Thus, the charge catching electrode 90 is electrically connected with the conductive plate 84 and with the brush member 86 accordingly.

With the above-described structure, when the corona wire 31 is applied with the electric voltage, the corona wire 31 discharges ions. A part of ions passes through the slits in the grid electrode portion 33 to reach the surface of the photosensitive drum 20, thereby electrically charging the photosensitive drum 20. Another part of ions reaches the charge catching electrode 90 through the opening D of the metal shield 34 and the opening B of the support member 36, thereby electrically charging the charge oat catching electrode 90. In other words, the charge catching electrode 90 directly receives ions discharged from the corona wire 31 and is electrically charged by the ions. The conductive plate 84 and the brush member 86 are therefore electrically charged. That is, an electric voltage is applied to the brush member 86 without a separate power source being provided for the brush member 86.

Thus, according to the present embodiment, the charge catching electrode 90 serves to supply an electric voltage to the brush member 86. It is noted that during the image transfer process, the sheet of paper is applied with the transfer bias voltage with a polarity opposite to that of toner. Accordingly, paper dust is charged to the polarity opposite to that of toner. On the other hand. because the reversal developing method is employed in the present embodiment, the polarity of the voltage applied to the corona wire 31 is the same polarity as toner. Therefore, the charge catching electrode 90 is charged to the same polarity with toner. Accordingly, the brush member 86 is charged also to the same polarity as toner. Therefore, the brush member 86 can properly collect paper dust.

Thus, according to the present embodiment, the brush member 86 is applied with an appropriate voltage without a separate power source being provided. Accordingly, the number of components in the image forming apparatus 1 can be further reduced. The production costs can be drastically reduced.

The charge catching electrode 90 is basically charged to an electric voltage with an amount equivalent to that of the corona wire 31. However, the voltage value of the charge catching electrode 90 can be controlled to a certain extent by adjusting a positional relationship between the charge catching electrode 90 and the shield portion 32 of the metal shield 34. More specifically, it in possible to control the voltage of the charge catching electrode 90 by adjusting the size of the opening D and the distance between the opening D and the charge catching electrode 90. For example, the voltage of the charge catching electrode 90 is reduced if the pair of shield portions 32 are extended with their tip ends reaching the opening B in the base wall 37.

It is possible to roughly control the amount of electric currents flowing through the charge catching electrode 90 by adjusting an exposure rate of the charge catching electrode 90 to the corona wire 31. It is assumed that the corona wire 31 uniformly discharges ions in all the directions and that the corona wire 31 has a cylindrical shape. The amount of charges "q" that pass through an area of an amount "s", which is visible from the corona wire 31 and which is separated from the corona wire 31 by a distance "R", can be calculated by the following formula:

$$q=s\cdot Q/2\pi R\cdot L$$

wherein "Q" is the total amount of charges generated from the corona wire 31 and "L" is a length of the corona wire 31.

The exposure rate is defined as a ratio of the surface area "s", of the charge catching electrode 90 visible via the opening B from the corona wire 31, with respect to the entire surface area "2πR·L" of an imaginary cylindrical space surrounding the corona wire 31. That is, the exposure rate "ER" is defined by the following formula:

$$ER=s/2\pi R\cdot L$$

Accordingly, "q" can be determined by q=Q·ER.

For example, it is assumed that the corona wire 31 has the length "L" of 230 mm, that the charge catching electrode 90 is separated from the corona wire 31 by the distance "R" of 5 mm, that the opening B has a width "w" of 5 mm along the widthwise direction of the shield casing 35, and that the charge catching electrode 90 has a length "L1" of 5 mm along the lengthwise direction of the shield casing 35. In this case, the surface area "s" of the charge catching electrode 90 visible through the opening B from the corona wire 31 is calculated as 25 $mm^2$ (=5 mm×5 mm). Accordingly, the exposure rate ER (=s/2πR·L) is calculated as 1/289.0265≈1/300. The amount "q" of charges passing through the charge catching electrode 90 can therefore be calculated as follows:

$$q=Q\cdot ER=Q/289.0265\approx Q/300.$$

The amount of charges passing through the charge catching electrode 90 is proportional to the amount of electric currents reaching the charge catching electrode 90. It can therefore be known that the amount of electric currents reaching the charge catching electrode 90 is about 1/300 of the total electric currents flowing through the corona wire 31. Accordingly, when the corona wire 31 is applied with a fixed current of 300 $\mu$A, for example, then currents of about 1 $\mu$A will flow through the charge catching electrode 90.

It is possible to control the exposure rate ER by adjusting the surface area "s" of the charge catching electrode 90 exposed to the corona wire 31 through the opening B. It is therefore possible to control the amount of currents flowing through the charge catching electrode 90 by adjusting the amount how the charge catching electrode 90 is exposed to the opening B in the lengthwise direction of the shield casing 35. This adjustment can be achieved by adjusting the length L1 of the charge catching electrode 90 along the lengthwise direction of the shield casing 35.

In the above description, the exposure rate "ER" is defined under the assumption that the corona wire 31 discharges ions uniformly in all the directions, that is, under the assumption that the metal shield 34 is applied with no grid bias voltage. When the metal shield 34 is applied with the grid bias voltage of some amount, the electric potential of the metal shield 34 will affect the corona wire 31, so the corona wire 31 will discharge ions non-uniformly. In this case, the amount of currents flowing through the charge catching electrode 90 will shift from the calculated theoretical value. It is necessary to determine the amount of currents based on actual experimental results.

As described above, the Scorotron type charge unit 30 includes the shield casing 35 which is formed with the opening B. The charge catching electrode 90 spans across the opening B. The charge catching electrode 90 is electrically connected to the conductive plate 84, on which the brush member 86 is provided. With this configuration, the charge catching electrode 90 supplies the brush member 86 with an electric voltage in the same polarity as that of charged toner.

In this example, the charge unit 30 is a positive polarity scorotron charge unit. Therefore, the amount of generated ozone which affects to the environment can be greatly reduced.

Because both of the charge catching electrode 90 and the brush member 86 are provided inside the process cartridge 7, it in unnecessary to energize the brush member 86 from outside of the process cartridge 7. Accordingly, there is no need to provide the process cartridge 7 with any electrical contacts for being electrically connected to the main body of the image forming device 1 to energize the brush member 86.

According to a modification of the present embodiment, a as shown in FIG. 5, the charge catching electrode 90 may be electrically connected also to the layer thickness regulating blade 58 and to a seal somber 101 via a wire or the like. In this case, the charge catching electrode 90 can apply electric voltages also to the layer thickness regulating blade 58 and to the seal member 101. The seal member 101 is for rubbing against the developer roller 57 so as to prevent toner from falling out of the development chamber 55.

Generally, when the reverse developing method is used. the charge unit 30 is applied with an electric voltage having the some polarity with the charge of the toner The layer thickness regulating blade 58 and the seal member 101 are also usually applied with the voltage having the same polarity as the charge of the toner. Accordingly, using the charge catching electrode 90 as the voltage source of these components is convenient.

All of the charge catching electrode 90, the brush member 56, the layer thickness regulating blade 58, and the seal member 101 are provided inside the process cartridge 7. Accordingly, it is unnecessary to energize the members 86, 58, or 101 from outside of the process cartridge 7. There is no need to provide the process cartridge 7 with any electrical contacts for being electrically connected to the main body of the image forming device 1 to energize the members 86, 58, and 101.

The charge catching electrode 90 can be electrically connected also to the fixing unit 70. In this case, the fixing unit 70 is applied with the electric voltage in the same polarity as the charged toner. An electrostatic offset can therefore be prevented. The charge catching electrode 90 can be electrically connected also to another paper dust removing unit (not shown) that is disposed along the sheet transport pathway 6 in the image forming apparatus 1. By applying a voltage with the same polarity as the polarity of the toner, the other paper dust removing unit can properly remove paper dust.

In this example, those components, which are applied with electric voltages from the charge catching electrode 90, are not provided within the process cartridge 7, but are provided within the main body of the image forming apparatus 1. Accordingly, the charge catching electrode 90 may preferably be mounted in the main body of the apparatus 1, rather than being mounted in the process cartridge 7. The charge catching electrode 90 may preferably be mounted in the housing 2 of the image forming apparatus 1 at a location that is in the vicinity of the opening B of the charging unit 30. There becomes no need to provide the process cartridge 7 with any electrical contact points for being electrically connected with the main body of the image forming apparatus 1 to energize those components by the charge catching electrode 90.

A protective resistor can be connected in series between the charge catching electrode 90 and the components to which the charge catching electrode 90 apply voltages. It is desirable to use, as the protective resistor, a resistor with a resistance value of 500 MΩ or greater in order to control current value.

Figure 6:
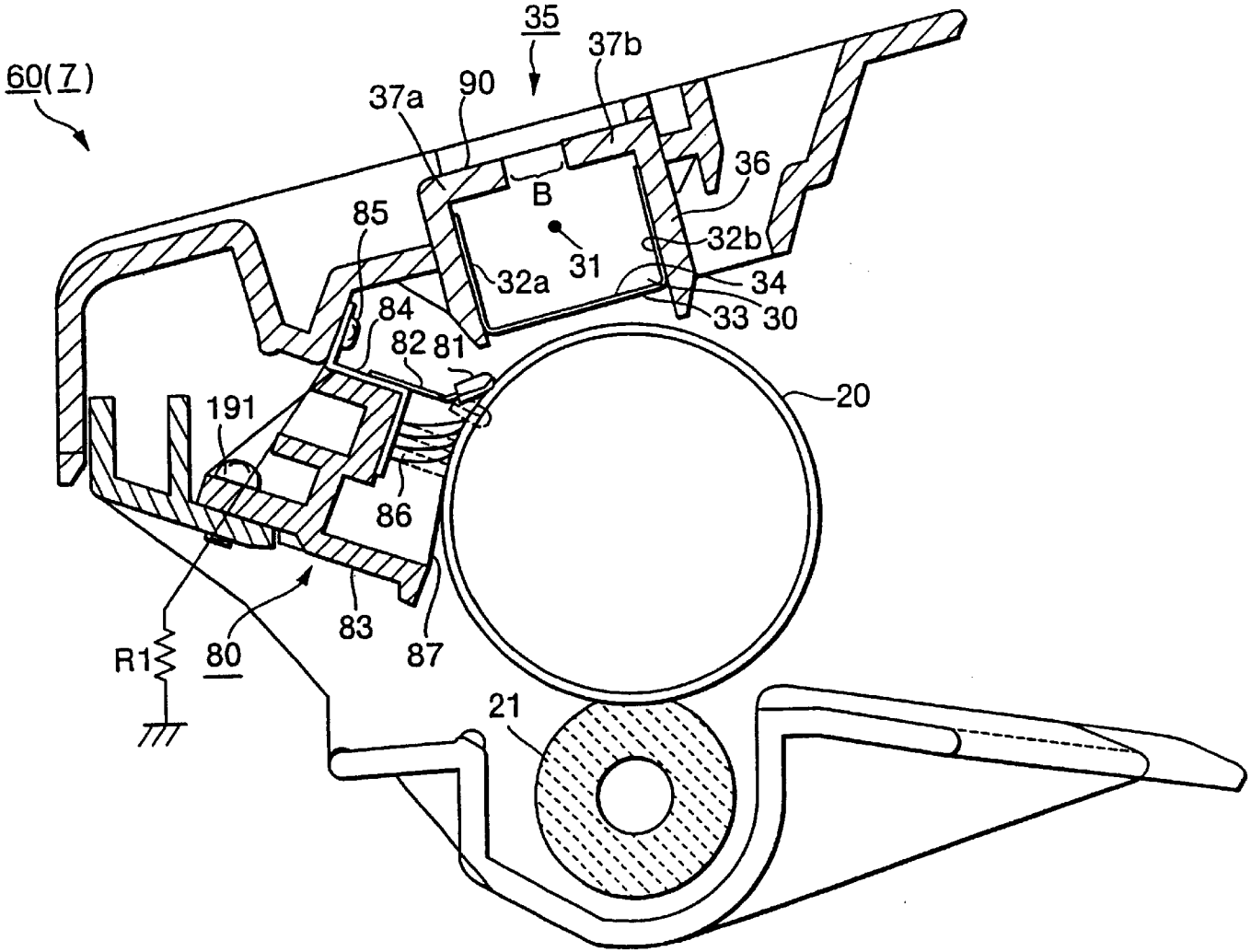
FIG. 6 is a cross-sectional view showing components in the vicinity of the paper dust removal unit and the charge unit according to another modification of the second embodiment.

According to another modification, as shown in FIG. 6, the brush member 86 may be electrically connected to the ground via a resistor R1 with a high amount of resistance. The resister R1 may be electrically connected with the ground terminal of the photosensitive drum 20. In the present embodiment, the resister R1 has a high resistance value of 500 MΩ to 1 GΩ.

With this configuration, even when resistance value of the brush member 86 is reduced when the ambient environment becomes highly humid or damp, for example, the currents from the brush member 86 will flow through the resister R1 without flowing a great deal to the photosensitive drum 20.

As a result, defects in the photosensitive drum 20 will not occur because of large current flow. Furthermore, defective images that can be caused by such defects in the photosensitive drum 20 can be reliably prevented.

Figure 7:
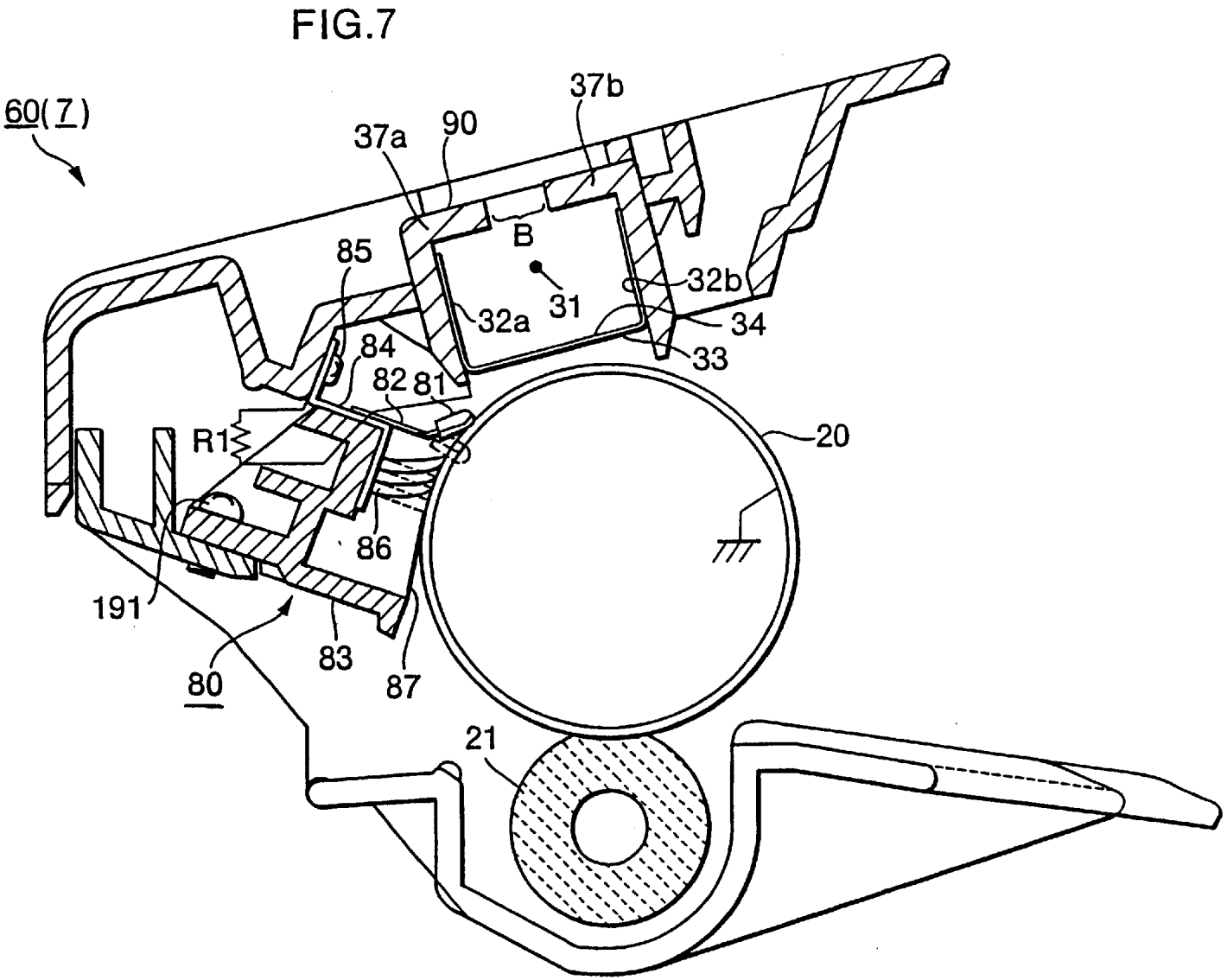
FIG. 7 is a cross-sectional view showing components in the vicinity of the paper dust removal unit and the charge unit according to still another modification of the second embodiment.

According to another modification, as shown in FIG. 7, the ground terminal of the resister R1, that is connected to the ground in the example of FIG. 6, can be connected to the grid electrode 33. The grid electrode 33 is applied with the predetermined voltage (grid voltage) from the voltage source 39*b* (FIG. 4(B)). With this configuration, a large current can be prevented from flowing from the brush member 86 to the photosensitive drum 20. In addition, the minimum voltage applied to the brush member 86 can be regulated by the grid voltage. Even when the ambient environment is highly humid or damp, the voltage applied to the brush member 86 can be stable.

Thus, as described with reference to FIGS. 6 and 7, the brush member 86 is electrically connected through the resister R1 to the ground or to the grid 33. Therefore, a large current can be prevented from flowing from the brush member 86 to the photosensitive drum 20.

Figure 8A:
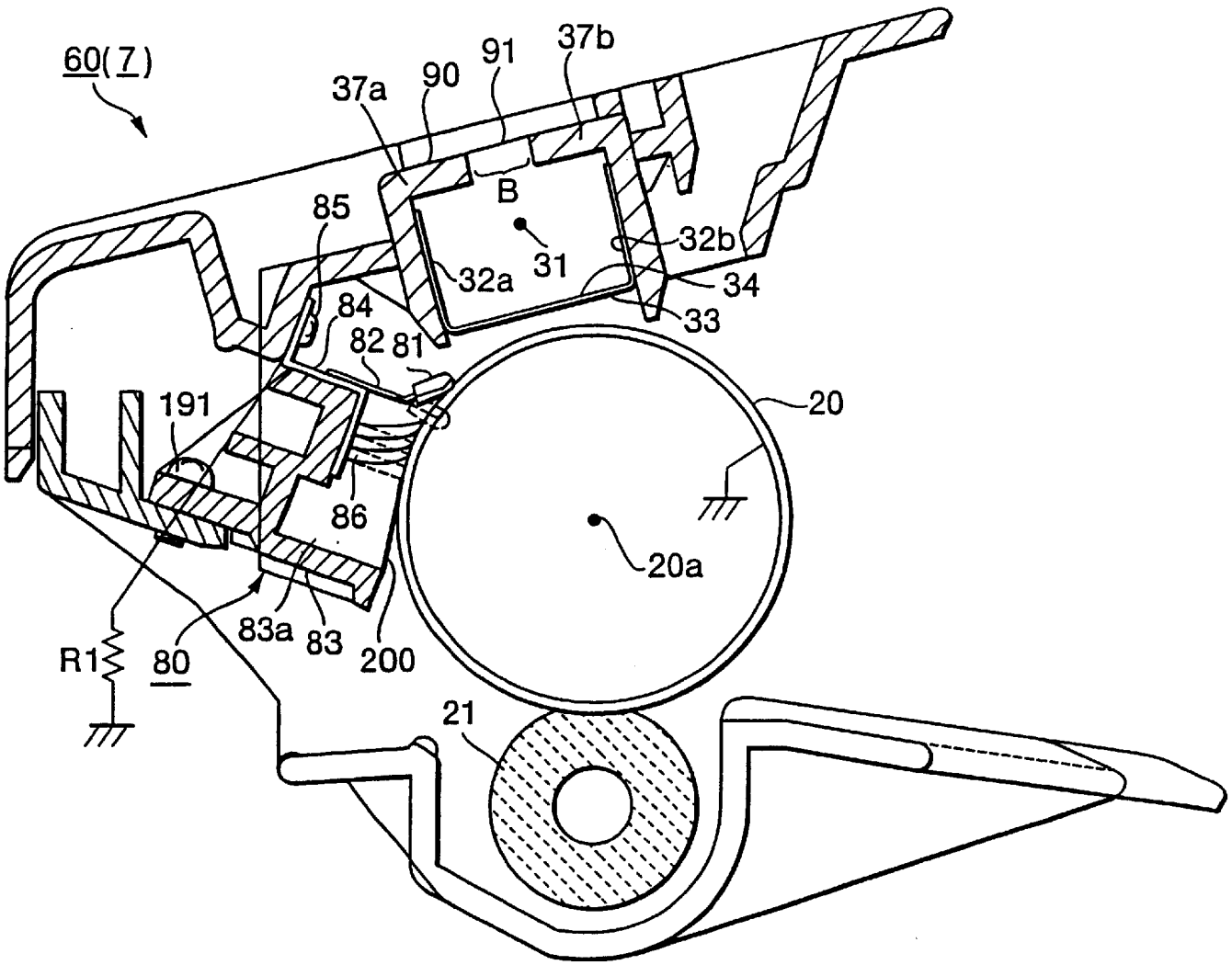
FIG. 8(A) is a cross-sectional view showing components in the vicinity of the paper dust removal unit and the charge unit according to another modification of the second embodiment.
Figure 8:
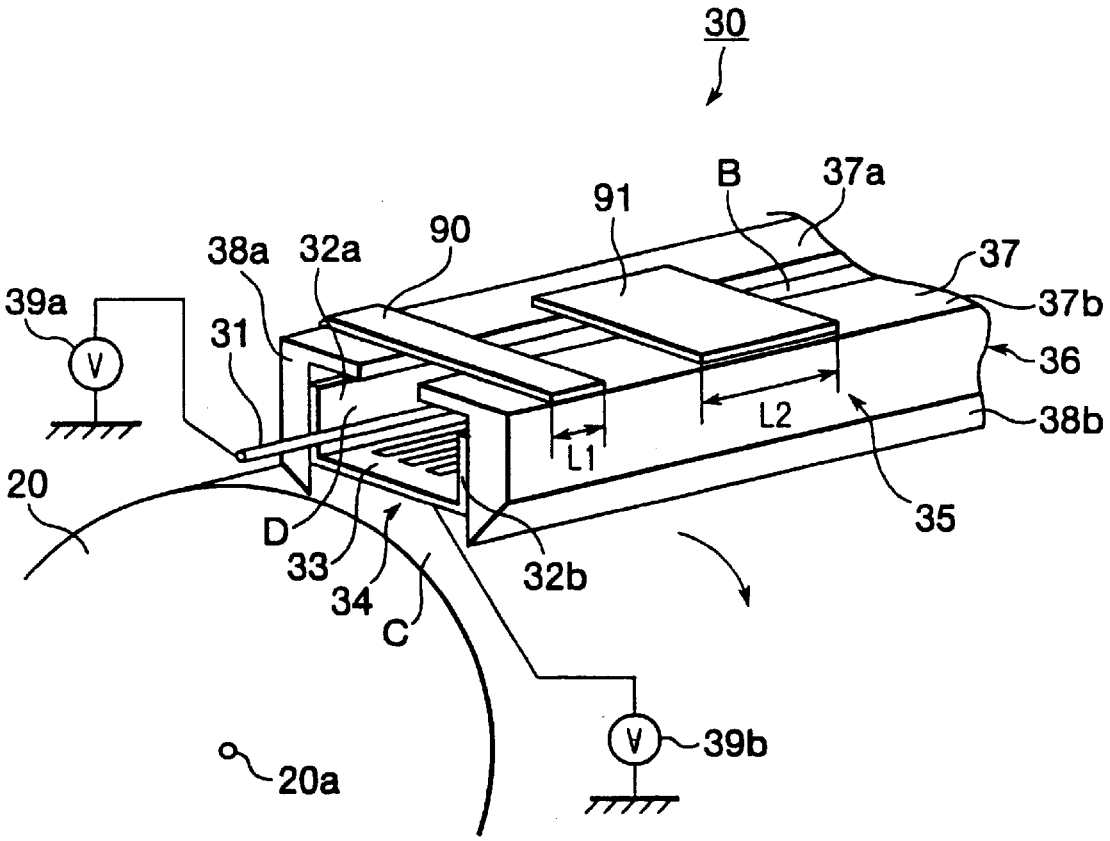
FIG. 8(B) is a perspective view showing the charge unit employed in the modification of FIG. 8(A)

According to another modification, a charge removal film 200 may be provided, as shown in FIG. 8(A) instead of the urethane film 87. The charge removal film 200 serves to remove electric charges from the photosensitive drum 20 after the transfer process and also serves to prevent paper dust from falling out of the holding chamber 83*a* of the holder 83 similarly to the urethane film 87.

In this case, an additional charge catching electrode 91 may be provided in addition to the charge catching electrode 90 as shown in FIG. 8(B). The additional charge catching electrode 91 is electrically connected to the charge removal film 200 via a wire or the like. The charge removal film 200 is therefore applied with an electric voltage from the additional charge catching electrode 91.

The charge removal film 200 is formed from a metal, such as a stainless steel or aluminum, or a synthetic resin, such as urethane, acryl, or nylon. When synthetic resin is used for the charge removal film 200, it is necessary to provide the charge removal film 200 with electric conductivity by dispersing carbon to the surface of the charge removal film 200. In the present embodiment, the charge removal film 200 has a resistivity value of $10^2$ Ωcm to $10^8$ Ωcm. As shown in FIG. 8(A), the charge removal film 200 extends parallel to the rotational axis 20*a* of the photosensitive drum 20 and uniformly contacts the surface of the photosensitive drum 20.

According to this modification, the additional charge catching electrode 91 is provided separately from the charge catching electrode 90. The additional charge catching electrode 91 is of a plate shape similarly to the charge catching electrode 90. The charge catching electrodes 90 and 91 are provided on the outer surface of the base wall 37 as being arranged adjacent to each other in the lengthwise direction of the shield casing 35. The charge catching electrodes 90 and 91 are arranged out of contact with each other. Each of the charge catching electrodes 90 and 91 is exposed to the corona wire 31 through the opening B of the base wall 37 and through the opening D of the metal shield 34.

The voltage required by the charge removal film 200 is much larger than the voltage required by the brush member 86. It is noted that the value of an electric voltage supplied from each charge catching electrode 90, 91 is determined by the surface area of the subject charge catching electrode 90, is 91 that confronts the corona wire 31 via the openings B and D. Therefore, the surface area of the additional charge catching electrode 91 in confrontation with the corona wire 31 is set larger than the surface area of the charge catching electrode 90 that confronts the corona wire 31. In this example, both of the charge catching electrodes 90 and 91 are provided to span across the opening B. Accordingly, the length L2 of the additional charge catching electrode 91 in the lengthwise direction of the shield casing 35 is set longer than the length L1 of the charge catching electrode 90. In this example, the additional charge catching electrode 91 is provided to the base wall 37 so that its surface area confronting the corona wire 31 via the openings B and D will have a value that can apply an electric voltage of 800 volts to 900 volts to the charge removal film 200.

The charge catching electrodes 90 and 91 may not be arranged as described above. The charge catching electrodes 90 and 91 may be arranged in other manners as long as they can apply required voltages to the brush member 86 and the charge removal film 200, respectively.

It is noted that after transfer operations, the surface potential on the photosensitive drum 20 is 100V to 200V lower at regions where toner images have been formed than at regions where no toner images have been formed. The charge removal film 200 removes nonuniformity in the surface potential on the photosensitive drum 20 before charging operation by the charge unit 30. Therefore, it is ensured that the charge unit 30 can uniformly charge the photosensitive drum 20 thereafter.

Because there is no need to provide a separate power source for the charge removal film 200, the entire image forming apparatus 1 can be formed smaller with lower cost.

Further, the resistivity value of the charge removal film 200 is set to $10^2$ Ωcm to $10^8$ Ωcm. Therefore, the charge removal film 200 can contact the photosensitive drum 20 without a large current flowing to the photosensitive drum 20. Because the photosensitive drum 20 will not be damaged because of a large current flowing to the photosensitive drum 20, defective images because of a damage to the photosensitive drum 20 can be reliably prevented.

The charge removal film 200 serves not only to remove charges from the photosensitive drum 20 but also to prevent paper dust from falling out of the holder chamber 83*a*. With such configuration, charge removing operations can be performed without increasing the entire size of the image forming apparatus 1.

It is noted that a charge removal brush or a charge removal roller can be used instead of the charge removal film 200 as long as it functions to remove charge from the photosensitive drum 20. The charge removal brush or roller can be disposed in confrontation with the photosensitive drum 20 without contacting thereto. The charge removal brush or roller is electrically connected to the additional charge catching electrode 91.

Also in the present modification, as shown in FIG. 8(A), the brush member 86 is electrically connected with the ground via the resistor R1 with a high resistance of, for example, 500 MΩ to 1 GΩ. It is noted, however, that the resistor R1 may not be connected with the ground, but may be connected with the grid electrode 33 in the same manner as in the modification of FIG. 7. With this configuration, no large amounts of current will flow from the brush member 86 to the photosensitive drum 20. Also, the minimum voltage applied to the brush member 86 can be determined by the voltage applied to the grid electrode 33. Therefore, the voltage applied to the brush member 86 will be fairly stable even when the ambient environment is dump or highly humid.

Thus, the brush member 86, which is applied with an electric voltage from the charge catching electrode 90, is connected through the high resistance resister R1 to the ground or to the grid electrode 33. In addition, the charge removing film 200 is applied with the electric voltage from the charge catching electrode 91. Therefore, a large current can be prevented from generating between the brush member 86 and the photosensitive drum 20. and charge can be properly removed from the photosensitive drum 20 so that the photosensitive drum 20 can be uniformly charged by the charge unit 30 thereafter.

Figure 9A:
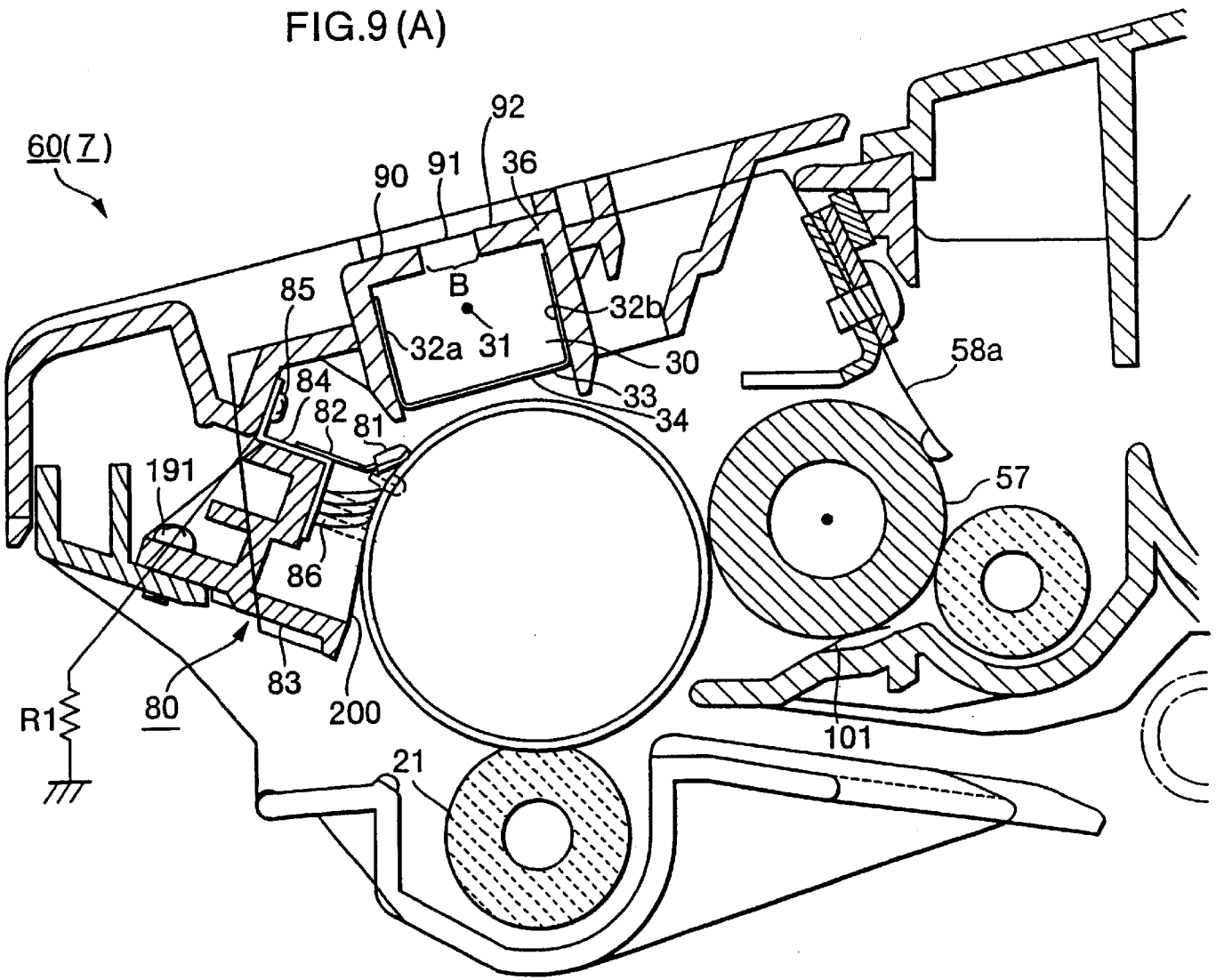
FIG. 9(A) is a cross-sectional view showing components in the vicinity of the paper dust removal unit and the charge unit according to still another modification of the second embodiment.
Figure 9:
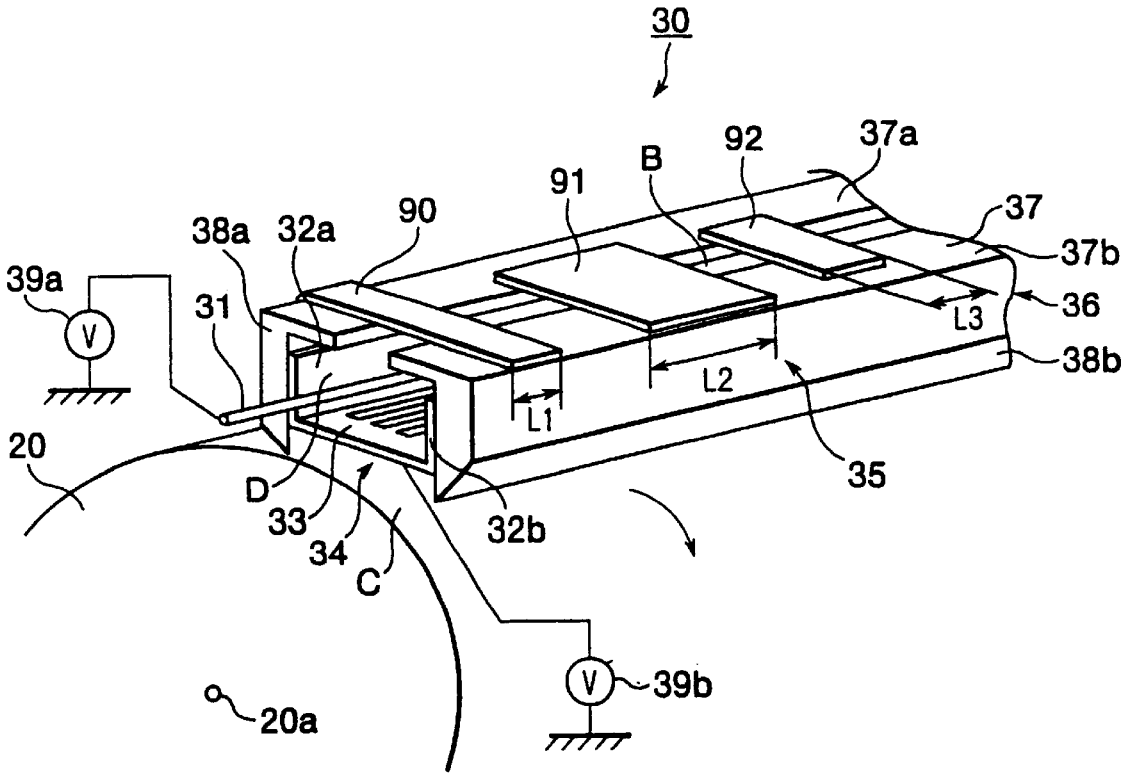
FIG. 9(B) is a perspective view showing the charge unit employed in the modification of FIG. 9(A)

As shown in FIGS. 9(A) and 9(B). another additional charge catching electrode 92 may be provided to the charge unit 30. The charge catching electrode 92 is electrically connected to the layer-thickness regulating blade 58 via a wire or the like. The charge catching electrode 92 therefore applies an electric voltage to the layer-thickness regulating blade 58.

Because the brush member B6, the charge removal film 200, and the layer thickness regulating blade 58 all require different voltages, the charge catching electrodes 90, 91, and 92 should have different surface areas confronting the corona wire 31 via the opening B. In this case, the charge catching electrodes 90, 91, and 92 are formed to have different lengths L1, L2, and L3, in the elongated direction of the shield casing 35.

With this configuration, the layer thickness regulating blade 58 is charged to polarity which is the same as that of the toner. As a result, oppositely-charged or uncharged toner will be prevented from passing by the layer thickness regulating blade 58 so that proper developing operations can be performed. The layer thickness regulating blade 58 can properly regulate the layer thickness of the toner on the development roller 58. Moreover, large currents can be prevented from flowing from the brush member 86 to the photosensitive drum 20 while the brush member 86 properly removes paper dust from the photosensitive drum 20. Moreover, charge removal operations can be properly performed by the charge removal film 200. There is no need to provide separate power sources for all these different purposes, so the entire size of the image forming apparatus 1 will remain small and production costs can be suppressed.

Still another charge catching electrode (not shown) can be further provided to apply an electric voltage to the seal member 101. In this case, because the seal member 101 is charged to the same polarity as the toner, toner leaks can be properly prevented by the seal member 101.

Alternatively, the charge catching electrode 92, which is provided to energize the layer-thickness regulating blade 58 in the example of FIGS. 9(A) and 9(B), may be electrically connected to the seal member 101, rather than being connected to the layer-thickness regulating blade 58. In this case, the charge catching electrode 90, 91, and 92 are used to apply electric voltages to the brush member 86, the charge removal film 200. and the seal member 101., respectively.

In this modification, all of the charge catching electrodes 90–92 and all of the components 86, 200, and 5B (or 101), which are supplied with electric voltages from the charge catching electrodes 90–92, are mounted in the process cartridge 7. Accordingly, there is no need to provide the process cartridge with electric contacts for being connected with the main body of the image forming apparatus 1 to energize those components 86, 200, 58 and 101. No defective electric contacts will occur. Therefore, proper image forming operations can be performed over a long period of time.

In the above description, the Scorotron charge unit 30 employs the wire-shaped corona electrode 31. However, the charge unit 30 can employ a corona electrode 31 of other shapes, such as a needle-shape corona electrode or a saw-shaped corona electrode.

Figure 10:
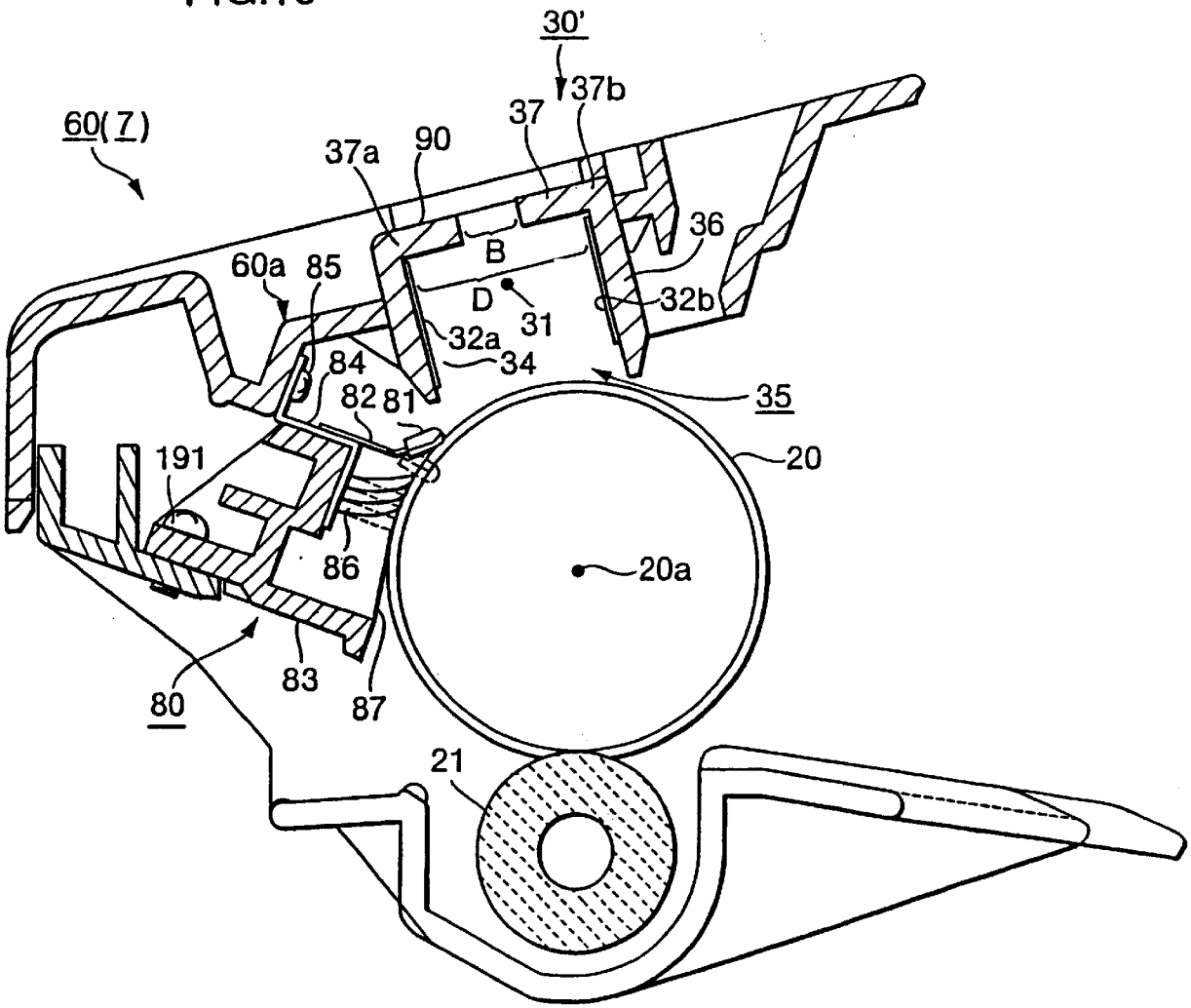
FIG. 10 is a cross-sectional view showing components in the vicinity of the paper dust removal unit and the charge unit according to still another modification of the second embodiment.

As shown in FIG. 10, a Corotron charge unit 30' can be employed instead of the Scorotron charge unit 30. The Corotron charge unit 30' has the same structure as that of the Scorotron charge unit 30, except that the metal shield 34 has the shield portions 32*a* and 32*b* only, but does not have the grid electrode portion 33.

Third Embodiment

Next, a third embodiment according to the present invention will be described while referring to FIG. 11. Components in the third embodiment with the same configuration as those in the first embodiment are is designated with the same numbering.

Figure 11:
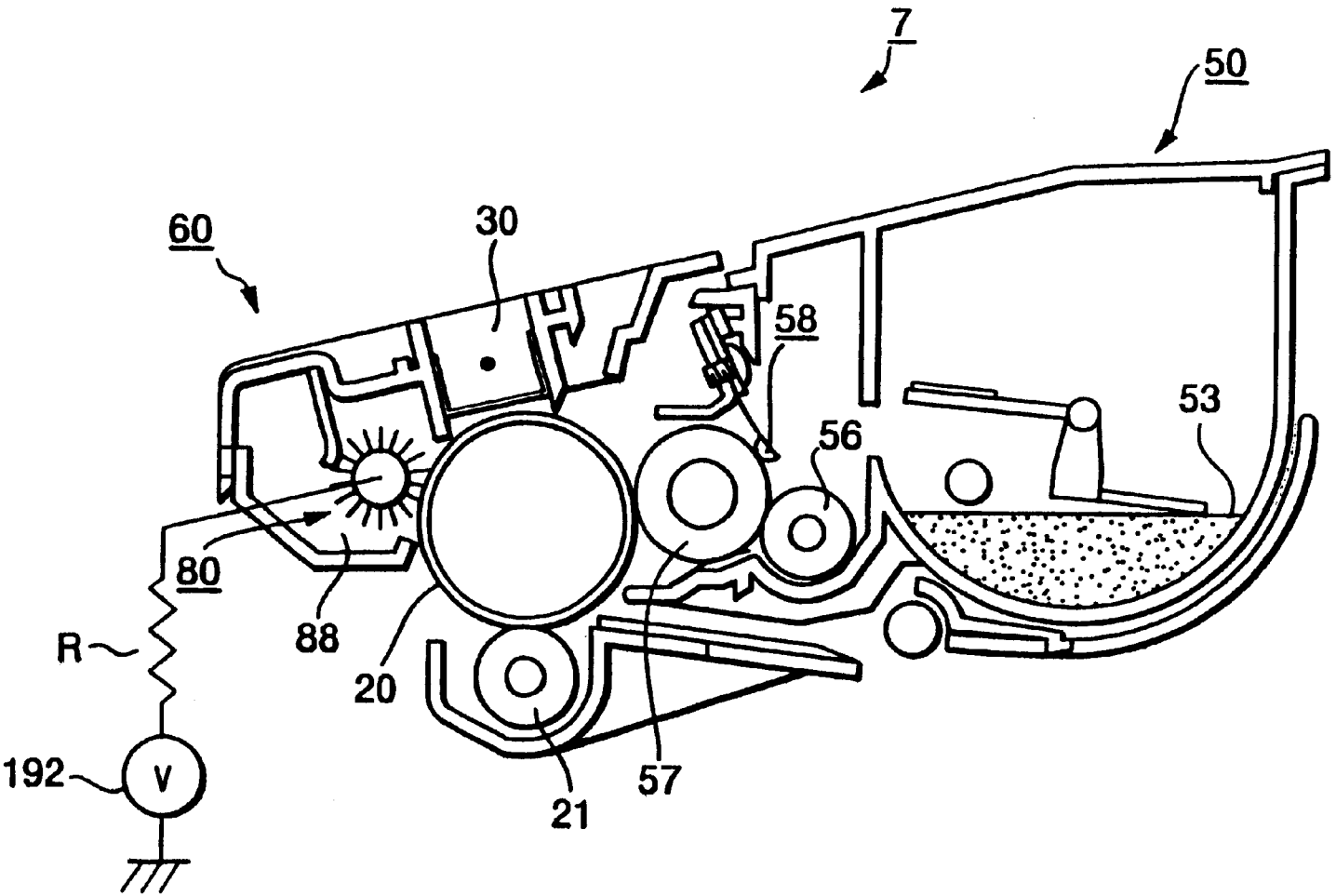
FIG. 11 is a cross-sectional view showing a process cartridge including a paper dust removal unit according to a third embodiment of the present invention.

As shown in FIG. 11, the paper dust removal unit 80 of the present embodiment is provided with a brush roller 88. The brush roller 88 is constructed from a metal core and a brush member provided around the metal core. The brush member of the brush roller 88 is formed from acrylic fibers which have not been subjected to conductivity-enhancing processes so have a high resistance value. The fixed voltage source 192 applies a predetermined high voltage to the metal core of the brush roller 88.

With this configuration, potential difference sufficient for removing paper dust can be maintained between the brush roller 88 and the photosensitive drum 20. Also, discharge from the brush roller 88 to the photosensitive drum 20 can be prevented, so nonuniformity in surface potential on the photosensitive drum 20 can be prevented. Accordingly, the charge removal lamp, such as EL, con be dispensed with, so the number of components can be reduced.

While the invention has been described in detail with reference to the specific embodiments thereof, it would be apparent to those skilled in the art that various changes and modifications may be made therein without departing from the spirit of the invention.

Figure 12:
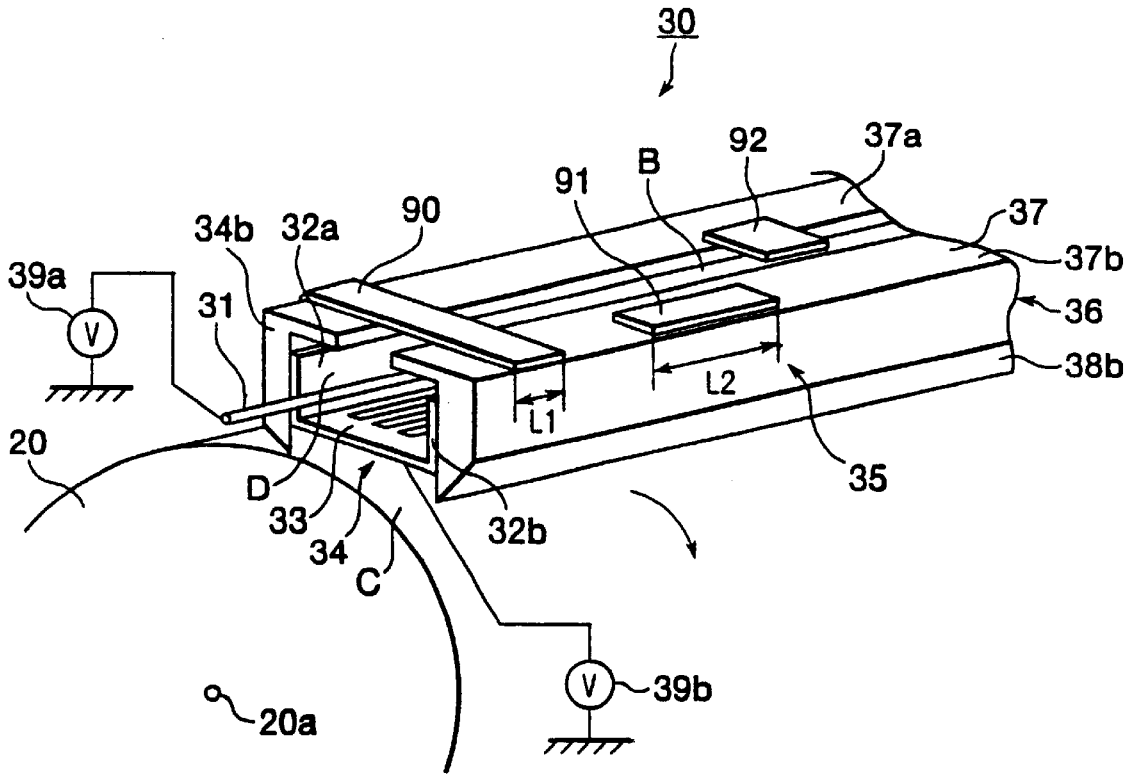
FIG. 12 is a perspective view showing a charge unit employed according to another modification.

For examples in the above-described embodiments, each of the charge catching electrodes 90–92 is provided to span across the opening B. However, the charge catching electrodes 90–92 may not be provided to span across the opening B. For example, each charge catching electrode can be provided to extend from one base section 37*a* or 37*b* but not to reach the other base section 37*b* or 37*a*. It is unnecessary for each charge catching electrode to directly confront the discharge wire 31 via the opening B. That is, each charge catching electrode can be provided not to be exposed to the opening B at all. FIG. 12 shows an example where the electrode 91 is provided not to be exposed to the opening B, and the electrode 92 is provided to extend from the base section 37*a* but not to reach the other base section 37*b*.

In the above-description, all the charge catching electrodes 90–92 are provided on the external surface of the base wall 37 of the shield casing 35. However, the charge catching electrodes 90–92 may not be located on the external surface of the base wall 37. They may be provided at other locations as long as they are located in the vicinity of the opening B of the base wall 37.

In the above-described embodiments, the photosensitive drum is used as an image bearing body that bears a toner visible image thereon and that conveys the toner visible image to the transfer position. However, the present invention can be applied to other image bearing bodies, such as an intermediate transfer body and the like that is used in a color image forming apparatus.

In the third embodiment, the charge catching electrode 90 may be provided, similarly to the second embodiment, to supply electric charges to the brush roller 88.

In the second embodiment, the charge catching electrode 90 is provided to apply am electric voltage to the brush member 86, and other charge catching electrodes 91 and 92 are provided to apply electric voltages to the charge removal film 200 and the layer-thickness regulating blade 58 or the seal member 101. However, at least one of the charge catching electrodes 91 and 92 may be provided, but the charge catching electrode 90 may not be provided. In this case, the brush member 86 is energized by the fixed voltage source 192 similarly as in the first embodiment.

The charge catching electrode 90 may be used to apply electric voltages only to the components, such as the fixing unit 70 and/or the other paper dust removing unit, which are provided within the main body of the image forming apparatus 1. The charge catching electrode 90 may not be used to energize the brush member 86.

What is claimed is:

1. An image forming apparatus, comprising:

an image bearing body having a surface that bears thereon a visible image, which is formed through development of an electrostatic latent image by developing agent, and that conveys the visible image to a predetermined transfer position;

a transfer member, located on the transfer position, transferring the visible image from the image bearing body onto a sheet of paper;

a paper dust removing member that removes paper dust clinging to the surface of the image bearing body, the paper dust removing member including a brush member that contacts the image bearing body and that is made of fiber material whose resistance has a value preventing discharges from occurring from the brush member toward the surface of the image bearing body; and a bias voltage applying member that applies an electric bias voltage to the paper dust removing member.

2. An image forming apparatus as claimed in claim 1, further comprising:

an electric charging unit that electrically charges the surface of the image bearing body to a predetermined voltage with a positive polarity;

an electrostatic image forming member that forms the electrostatic latent image on the electrically-charged surface of the image bearing body by causing an electric potential of a selected image region to drop to a lower electric potential while causing an electric potential at a remaining non-selected region to be maintained at the predetermined voltage; and a developing member that develops the electrostatic latent image into the visible image using toner with a positive polarity, wherein the transfer member transfers the visible image onto the sheet of paper by a transfer bias voltage of a negative polarity, thereby causing the paper to be charged to the negative polarity, and wherein the bias voltage applying member supplies the brush member with an electric voltage whose value has a positive polarity and is higher than the predetermined voltage, the brush member removing paper dust clinging to the surface of the image bearing body by using the supplied electric voltage while preventing discharges from occurring between the brush member and the surface of the image bearing body.

3. An image forming apparatus as claimed in claim 1, wherein the brush member is made of fiber material which has all the areas having resistance of $10^5$ Ω or more.

4. An image forming apparatus as claimed in claim 1, wherein the brush member is made of fiber material which has not been subjected to a conductivity-enhancing process.

5. An image forming apparatus as claimed in claim 1, wherein the brush member is made of fiber material whose resistance value is in a range of $10^8$ to $10^{10}$ Ω.

6. An image forming apparatus as claimed in claim 1, wherein the brush member is made of fiber material which has been subjected to a resistance-enhancing process.

7. An image forming apparatus as claimed in claim 6, wherein the brush member is made of fiber material which has been subjected to a degreasing process.

8. An image forming apparatus as claimed in claim 1, wherein the brush member is made of chemical fiber material.

9. An image forming apparatus as claimed in claim 8, wherein the brush member is made of acrylic fiber material.

10. An image forming apparatus as claimed in claim 9, wherein the brush member is made of acrylic fiber material which has not been subjected to a conductivity-enhancing process.

11. An image forming apparatus as claimed in claim 10, wherein the brush member is made of acrylic fiber material which has been subjected to a resistance-enhancing process.

12. An image forming apparatus as claimed in claim 11, wherein the brush member is made of acrylic fiber material which has been subjected to a degreasing process.

13. An image forming apparatus as claimed in claim 2, wherein the brush member is made of fiber material which has no local areas having resistance of $10^5$ Ω or less.

14. An image forming apparatus an claimed in claim 2, wherein the brush member is made of fiber material whose resistance value is in a range of $10^5$ to $10^{10}$ Ω.

15. An image forming apparatus as claimed in claim 1, wherein the bias voltage applying member supplies the paper dust removing member with an electric voltage that has an amount allowing a potential difference of one kilovolts or more to occur between the paper dust removing member and the surface of the image bearing body that confronts the paper dust removing member.

16. An image forming apparatus as claimed in claim 1, wherein the bias voltage applying member includes a voltage source that applies a fixed amount of voltage to the paper dust removing member.

17. An image forming apparatus as claimed in claim 1, wherein the bias voltage applying member includes a current limiting member that prevents an electric current of an amount greater than a predetermined upper limit value from flowing through the paper dust removing member.

18. An image forming apparatus as claimed in claim 1, wherein the bias voltage applying member includes:

a voltage source; and a resistor connected in series between the voltage source and the paper dust removing member.

19. An image forming apparatus as claimed in claim 1, further comprising an additional paper dust removing member that is located downstream of the paper dust removing member in a moving direction in which the image bearing body moves to convey the visible image, the additional paper dust removing member including a sheet-shaped base member and a non-woven cloth provided to a tip end of the sheet-shaped base member, the sheet-shaped base member being positioned relative to the image bearing body so as to resiliently bend in the same direction with the moving direction of the image bearing body, thereby causing the non-woven cloth to contact the image bearing body.

20. An image forming apparatus as claimed in claim 1, further comprising:

an electric charging unit that has a corona discharge electrode generating a corona discharge to electrically charge the surface of the image bearing body; and an electrostatic latent image forming unit that forms the electrostatic latent image on the electrically-charged surface of the image bearing body; and a developing unit that develops the electrostatic latent image into the visible image by using the developing agent, wherein the bias voltage applying member includes an electric charge catching electrode for catching electric charge discharged from the corona discharge electrode and for applying the electric charge to the paper dust removing member.

21. An image forming apparatus as claimed in claim 20, wherein the electric charge catching electrode is provided to confront the corona discharge electrode.

22. An image forming apparatus as claimed in claim 20, wherein the electric charge catching electrode is electrically connected to the paper dust removing member.

23. An image forming apparatus as claimed in claim 22, wherein the electric charging unit includes a scorotron charge unit, the scorotron charge unit including:

a corona discharge wire generating a corona discharge to supply electric charges to the surface of the image bearing body; and a shield portion that confronts the corona discharge wire and that has an opening at a position confronting the image bearing body.

24. An image forming apparatus as claimed in claim 20, wherein the electric charging unit includes a scorotron charge unit, the scorotron charge unit including:

a corona discharge wire generating a corona discharge to supply electric charges to the surface of the image bearing body;

a shield portion that confronts the corona discharge wire and that has an opening at a position confronting the image bearing body; and a grid electrode that is provided covering the opening of the shield portion and that is formed integrally with the shield member.

25. An image forming apparatus as claimed in claim 20, further comprising an electric power supply that supplies the electric charging unit with an electric voltage of a positive polarity, thereby allowing the electric charging unit to generate electric charges with positive polarity.

26. An image forming apparatus me claimed in claim 20, further comprising:

a process cartridge housing that mounts therein the electric charging unit, the developing unit, the electric charge catching electrode, and the paper dust removing member; and an apparatus housing that mounts therein the electrostatic latent image forming member, the process cartridge housing being detachably mounted in the apparatus housing.

27. An image forming apparatus as claimed in claim 20, wherein the paper dust removing member is electrically connected to the charge catching electrode and is electrically connected also to the ground via a resistor in series.

28. An image forming apparatus as claimed in claim 24, wherein the paper dust removing member is electrically connected to the charge catching electrode and is electrically connected also to the grid electrode via a resistor in series.

29. An image forming apparatus as claimed in claim 20, wherein the developing unit includes:

a development body having a surface that bears thereon the developing agent and that has another electric potential that has a predetermined relationship with the electric potential of the image bearing body, the development body developing, using the developing agent, the electrostatic latent image on the image bearing body into the visible image; and a slide contacting member that is being in slide contact with the surface of the development body and that adjusts a thickness of the developing agent provided on the surface of the development body.

30. An image forming apparatus as claimed in claim 20, further comprising an electric charge removing unit that is located in contact with the image bearing body at a position downstream of the transfer position in a moving direction, in which the image bearing body moves to convey the visible image, and that removes electric charges from the image bearing body.

31. An image forming apparatus as claimed in claim 29, wherein the electric charge catching electrode is electrically connected further to the slide contacting member, thereby supplying electric charges to the slide contacting member.

32. An image forming apparatus as claimed in claim 30, wherein the electric charge catching electrode includes:

a first electric charge catching electrode that is electrically connected to the paper dust removing device; and a second electric charge catching electrode that is electrically connected to the electric charge removing unit.

33. An image forming apparatus as claimed in claim 30, wherein the developing unit includes:

a development body having a surface that bears thereon the developing agent and that has another electric potential that has a predetermined relationship with the electric potential of the image bearing body, the development body developing, using the developing agent, the electrostatic latent image on the image bearing body into the visible image; and a slide contacting member that is being in slide contact with the surface of the development body and that adjusts a thickness of the developing agent provided on the surface of the development body, and wherein the electric charge catching electrode includes:

a first electric charge catching electrode that is electrically connected to the paper dust removing device;

a second electric charge catching electrode that is electrically connected to the electric charge removing unit; and a third electric charge catching electrode that is electrically connected to the slide contacting member.

34. An image forming apparatus as claimed in claim 30, wherein the electric charge removing unit includes an electric conductive film having a resistivity in a range of $10^2$ Ωcm to $10^8$ Ωcm.

35. An image forming apparatus as claimed in clam 34, wherein the paper dust removing member further includes a holder for collecting paper dust removed by the brush member, and wherein the electric conductive film is provided to the holder in elastic contact with the image bearing body, thereby preventing paper dust removed by the brush member from falling out of the holder.

36. A process cartridge detachably mounted in an image forming device, the process cartridge comprising:

an image bearing body having a surface that bears thereon a visible image formed by developing agent a paper dust removing member that removes paper dust clinging to the surface of the image bearing body, the paper dust removing member including a brush member that contacts the image bearing body and that is made of fiber material whose resistance has a value preventing discharges from occurring from the brush member toward the surface of the image bearing body; and a bias voltage applying member that applies an electric bias voltage to the paper dust removing member.

37. A process cartridge as claimed in claim 36, further comprising:

an electric charging unit that has a corona discharge electrode generating a corona discharge to electrically charge the surface of the image bearing body;

a developing unit that develops an electrostatic latent image into the visible image by using the developing agent; and a transfer member, located on a transfer position, transferring the visible image from the image bearing body onto a sheet of paper, wherein the bias voltage applying member includes an electric charge catching electrode for catching electric charge discharged from the corona discharge electrode and for applying the electric charge to the paper dust removing member.

* * * * *